US008712001B2

(12) United States Patent
Singh et al.

(10) Patent No.: US 8,712,001 B2
(45) Date of Patent: Apr. 29, 2014

(54) FUEL BASKET SPACER, APPARATUS AND METHOD USING THE SAME FOR STORING HIGH LEVEL RADIOACTIVE WASTE

(75) Inventors: Krishna Singh, Jupiter, FL (US); Stephen Agace, Marlton, NJ (US)

(73) Assignee: Holtec International, Inc.

( * ) Notice: Subject to any disclaimer, the term of this patent is extended or adjusted under 35 U.S.C. 154(b) by 0 days.

(21) Appl. No.: 11/772,620

(22) Filed: Jul. 2, 2007

(65) Prior Publication Data

US 2008/0031397 A1 Feb. 7, 2008

Related U.S. Application Data

(60) Provisional application No. 60/818,100, filed on Jun. 30, 2006, provisional application No. 60/837,956, filed on Aug. 16, 2006.

(51) Int. Cl.

| | |
|---|---|
| ***G21F 5/005*** | (2006.01) |
| ***G21F 5/06*** | (2006.01) |
| *G21F 5/00* | (2006.01) |

(52) U.S. Cl.

USPC ..... 376/272; 376/260; 588/1; 250/505.1; 250/506.1; 250/507.1

(58) Field of Classification Search

USPC ..... 250/507.1, 506.1, 505.1; 376/272, 260; 588/1

See application file for complete search history.

(56) References Cited

U.S. PATENT DOCUMENTS

| | | | | |
|---|---|---|---|---|
| 3,780,306 | A * | 12/1973 | Anderson et al. | 250/428 |
| 4,800,283 | A * | 1/1989 | Efferding | 250/507.1 |
| 4,827,139 | A * | 5/1989 | Wells et al. | 250/507.1 |
| 4,896,046 | A * | 1/1990 | Efferding | 250/507.1 |
| 4,930,650 | A * | 6/1990 | Wells | 220/507 |
| 5,114,666 | A * | 5/1992 | Ellingson et al. | 376/272 |
| 5,438,597 | A * | 8/1995 | Lehnert et al. | 376/272 |
| 5,898,747 | A * | 4/1999 | Singh | 376/272 |
| 6,625,247 | B1 * | 9/2003 | Ohsono et al. | 376/272 |
| 6,839,395 | B2 * | 1/2005 | Ohsono et al. | 376/272 |
| 6,878,952 | B1 * | 4/2005 | Ohsono et al. | 250/506.1 |
| 6,898,258 | B2 * | 5/2005 | Ohsono et al. | 376/272 |
| 8,548,112 | B2 * | 10/2013 | Singh et al. | 376/272 |
| 2004/0141579 | A1 * | 7/2004 | Methling et al. | 376/272 |
| 2005/0117687 | A1 * | 6/2005 | Carver et al. | 376/272 |
| 2005/0286674 | A1 * | 12/2005 | Fischer et al. | 376/272 |

* cited by examiner

*Primary Examiner* — Bernarr Gregory
(74) *Attorney, Agent, or Firm* — The Belles Group, P.C.

(57) ABSTRACT

A fuel basket spacer, and system and method for storing high level radioactive waste. In one aspect, the invention is an apparatus for transporting and/or storing radioactive materials comprising: a body having a cavity for receiving radioactive materials; a basket positioned in the cavity comprising a plurality of cells; and a structure having an outer surface and an inner surface forming a central passageway; the structure positioned in the cavity so that the basket extends through the central passageway of the structure; and wherein the internal perimeter of the structure corresponds to the external perimeter of the basket in size and shape and the external perimeter of the structure corresponds to the perimeter of the cavity in size and shape. Circumferential clearances are provided between structure and the basket and the structure and the body that are eliminated when exposed to a residual heat load of the radioactive waste.

21 Claims, 16 Drawing Sheets

FUEL BASKET SPACER, APPARATUS AND METHOD USING THE SAME FOR STORING HIGH LEVEL RADIOACTIVE WASTE

CROSS-REFERENCE TO RELATED PATENT APPLICATIONS

The present application claims the benefit of U.S. Provisional Patent 60/818,100, filed Jun. 30, 2006 and U.S. Provisional Patent 60/837,956, filed Aug. 16, 2006, the entireties of which are hereby incorporated by reference.

FIELD OF THE INVENTION

The present invention relates generally to apparatus, systems and methods for transferring, supporting and/or storing high level waste ("HLW"), and specifically to containers and components thereof for transferring, supporting and/or storing radioactive materials, such as spent nuclear fuel.

BACKGROUND OF THE INVENTION

In the operation of nuclear reactors, it is customary to remove fuel assemblies after their energy has been depleted to a predetermined level. Upon removal, this spent nuclear fuel ("SNF") is still highly radioactive and produces considerable heat, requiring that great care be taken in its packaging, transporting, and storing. Specifically, SNF emits extremely dangerous neutron (i.e., neutron radiation) and gamma photons (i.e. gamma radiation).

It is imperative that these neutrons and gamma photons be contained at all times during transfer and storage of the SNF. It also imperative that the residual heat emanating from the SNF be lead away and escape from the SNF to avoid a critical event. Thus, containers used to transfer and/or store SNF must not only safely enclose and absorb the radioactivity of the SNF, they must also allow for adequate cooling of the SNF. Such transfer and/or storage containers are commonly referred to in the art as casks.

Generally speaking, there are two types of casks used for the transportation an/or storage of SNF, ventilated vertical overpacks ("VVOs") and thermally conductive casks. VVOs typically utilize a sealable canister that is loaded with SNF and positioned within a cavity of the VVO. Such canisters often contain a basket assembly for receiving the SNF. An example of a canister and basket assembly designed for use with a VVO is disclosed in U.S. Pat. No. 5,898,747 (Singh), issued Apr. 27, 1999, the entirety of which is hereby incorporated by reference. The body of a VVO is designed and constructed to provide the necessary gamma and neutron radiation shielding for the SNF loaded canister. In order to cool the SNF within the canister, VVOs are provided with ventilation passageways that allow the cool ambient air to flow into the cavity of the VVO body, over the surface of the canister and out of the cavity as warmed air. As a results, the heat emanated by the SNF within the canister is removed by natural convection forces. One example of a VVO is disclosed in U.S. Pat. No. 6,718,000 (Singh) et al.), issued Apr. 6, 2004, the entirety of which is hereby incorporated by reference.

The second type of casks are thermally conductive casks. In comparison to VVOs, thermally conductive casks are non-ventilated. In a typical thermally conductive cask, the SNF is loaded directly into a cavity formed by the cask body. A basket assembly is typically provided within the cavity itself to provide support for the SNF rods. As with the VVOs, the body of the thermally conductive cask is designed to provide the necessary gamma and neutron radiation shielding for the SNF. In contrast to VVOs, however, which utilize natural convective forces to remove the heat that emanates from the internally stored SNF, thermally conductive casks utilize thermal conduction to cool the SNF. More specifically, the cask body itself is designed to lead the heat away from the SNF via thermal conduction. In a typical thermally conductive cask, the cask body is mad of steel or another metal having high thermal conductivity. As a result, the heat emanating from the SNF is conducted outwardly from the cavity and through the cask body until it reaches the outer surface of the cask body. This heat is then removed from the outer surface of the cask body by the convective forces of the ambient air.

In some instances, the use of VVOs is either not preferred and/or unnecessary. This may be due to the heat load of the subject SNF, the existing set-up/design of the storage facility at which the SNF is to be stored and/or the nuclear regulations of the country in which the storage facility is located. However, existing designs of thermally conductive casks suffer from a number of drawbacks, including without limitation: (1) less than optimal heat removal; and (2) vulnerability to the escape of substantial radiation (i.e., shine). Additionally, existing methods of manufacture and designs of thermally conductive casks allow little to no flexibility in altering cask dimensions without a total redesign of the cask and/or retooling of the manufacturing facility.

SUMMARY OF THE INVENTION

These and other deficiencies are remedied by the present invention. In one aspect, the invention is based on a specially designed radiation shielding ring that surrounds the cavity of a containment boundary in which the HLW, such as SNF rods, is to be stored and/or transported. The containment boundary can be formed by any suitable container, including without limitation a multi-purpose canister, a cask, ventilated vertical overpack or other structure. The containment boundary preferably provides radioactive shielding and retains all particulate matter present therein. The radiation shielding ring provides improved gamma and neutron radiation shielding properties while facilitating improved cooling of the HLW inside the cavity by effectively conducting heat away from the HLW. The radiation shielding ring is preferably designed so that a plurality of the radiation shielding rings can be arranged in a stacked assembly that surrounds the height of the cavity. Collars are preferably provided at the interfaces formed between adjacent radiation shielding rings in the stacked assembly to prevent shine and improve radiation shielding.

In some embodiments, the inventive radiation shielding ring can also comprise a plurality of voids for receiving a neutron radiation absorbing material. It is preferred that the geometric layout of the voids within the radiation shielding ring be specially designed so that irrespective of the circumferential orientation (i.e., rotational position) of the radiation shielding rings in the stacked assembly, all of the voids of the radiation shielding rings are in spatial communication with all of the voids of the adjacent radiation shielding rings(s). As a result, neutron absorbing material can be flowed into the voids of the uppermost radiation shielding ring in the stacked assembly and fill all of the voids of the remaining radiation shielding rings in the stacked assembly. This can be done without worrying about the circumferential/rotational orientation of the radiation shielding rings with respect to one another.

In other embodiments, it may also be preferred that the geometric layout of the voids within the radiation shielding rings be specially designed so that a straight line does not exist radially from the cavity to the external atmosphere through the radiation shielding ring without passing through at least one of the voids (which is to be filled with a neutron radiation absorbing material). This design feature improves the containment of the neutron radiation emanating from HLW inside the cavity while still facilitating removal of heat from the HLW by conduction through the ring-like structure.

With respect to the radiation shielding ring, the invention can take on a wide variety of aspects. For example, the invention can be the radiation shielding ring itself and/or a container that utilizes one or more of the radiation shielding rings. In other examples, the invention can be a method of manufacturing the radiation shielding ring or a method of manufacturing a container that utilizes one or more of the radiation shielding rings. Still other examples include, a method of storing and cooling radioactive materials that produce a residual heat load and give off dangerous levels of neutron and gamma radiation. A number of embodiments of the invention that are based on the radiation shielding ring are set forth below with an understanding that those skilled in the art will understand that other embodiments of the invention exist.

In one embodiment, the invention can be an apparatus for transporting and/or storing radioactive materials comprising: a tubular shell having an outer surface and an inner surface forming a cavity for receiving the radioactive materials, the cavity having an open top end and a closed bottom end, the tubular shell having a height; a plurality of ring-like structures comprising an inner surface forming a central passageway extending axially through the ring-like structure, the ring-like structures surrounding the outer surface of the tubular shell in a stacked orientation, the tubular shell extending through the central passageways of the ring-like structures; and a collar connected to one or more of the ring-like structures and extending beyond a top or bottom surface of the ring-like structure to which the collar is connected, the collar surrounding the central passageway of the ring-like structure to which the collar is connected an extending into a channel on an adjacent ring-like structure.

It is preferred that all of the ring-like structures in the stack, except for the lower-most ring-like structure, comprise one of the collars. Preferably, the apparatus comprises at least three or more of the ring-like structures.

The inner surfaces of the ring-like structures, in some embodiments, can be a stepped surface having a first rise surface, a tread surface and a second riser surface. The first riser surface is preferably in contact with the outer surface of the tubular shell while the second surface is preferably spaced from the outer surface of the tubular shell, thereby forming the channel for receiving the collar between the second riser surface of the ring-like structure and the outer surface of the tubular shell. In this embodiment, the collar will preferably comprise the first riser surface of an adjacent ring-like structure.

The ring-like structures can comprise a plurality of voids that extend from the top surfaces of the ring-like structures to the bottom surface of the ring-like structures. As discussed above, the voids are preferably sized, shaped and arranged on the ring-like structures to that all of the voids of one of the ring-like structures are in spatial communication with all of the voids of the two adjacent ring-like structures when in the stacked assembly.

The ring-like structures can comprise an outer wall, a middle wall and an inner wall. In this embodiment, the middle wall is located between the inner wall and the outer wall in a spaced relation, such as concentric. The ring-like structures can further comprise a first set of fins connecting the inner wall to the middle wall and a second set of fins connecting the middle wall and the outer wall. Most preferably, the first and second set of fins are circumferentially offset from one another so that a radial path does not exist in the ring-like structures from the inner wall to the outer wall without passing through one of the voids. In such a set-up, a void is located between each of the fins of the first and second set of finds.

A neutron radiation absorbing material preferably fills the voids. It is also preferred that the shell, the ring-like structure and the collar be constructed of a gamma radiation absorbing material. The apparatus may also comprise a base made of a gamma radiation absorbing material. In this embodiment, the tubular shell is preferably positioned atop the base in a substantially vertical orientation. A lid assembly can be provided that substantially encloses the open end of the tubular shell. The lid assembly is preferably constructed of a gamma radiation absorbing material and is a non-unitary and removable structure with respect to the tubular shell and the ring-like structures.

The ring-like structures are preferably constructed of a material that expands when heated. Most preferably, the horizontal cross-sectional profiles of the central passageways of the ring-like structures are sized so that when the ring-like structures are at ambient temperature, the inner surfaces of the ring-like structure compresses against the outer surface of the tubular shell. However, when the ring-like structures are super-heated, the central passageways are slightly larger than the horizontal cross-sectional profile of the outer surface of the tubular shell. This facilitates ease of manufacturing when sliding the ring-like structures over the shell and ensures that the ring-like structures are in continuous surface contact with the shell, which facilitates heat removal by conduction. The superheating should be controlled so as to not reach a temperature that would affect the metallurgical properties of the material (e.g., metal) of which the ring-like structures are constructed. In one embodiment, the superheating is conducted at a temperature of 600 degrees Fahrenheit or less.

It is further preferred that the apparatus further comprise a basket assembly having a honeycomb-like grid that forms a plurality of substantially vertically oriented elongated cells. Most preferably, the basket assembly comprises one or more flux traps and is positioned within the cavity. The basket assembly can be constructed of a metal matrix composite material.

The tubular shell can be cylindrical in shape in some embodiments. As a result, the inner wall of the tubular shell with have a circular horizontal cross-sectional profile. In one embodiment, the basket assembly may have a horizontal cross-sectional profile having a perimeter that is not circular in shape. In such a situation, the apparatus will preferably further comprise a spacer having an inner surface forming a central passageway through the spacer and an outer surface. The spacer preferably has a horizontal cross-sectional profile having an internal perimeter formed by the inner surface of the space and a circular external perimeter formed by the outer surface of the spacer. The internal perimeter of the horizontal cross-sectional profile of the spacer preferably corresponds in shape to the perimeter of the horizontal cross-sectional profile of the basket assembly. The circular external perimeter formed by the outer surface of the spacer is preferably slightly smaller than the circular horizontal cross-sectional profile of the inner wall of the tubular shell. The spacer is positioned in the cavity so that the basket assembly extends through the central passageway of the spacer. In other words, the space surrounds the basket assembly. In one embodiment, a plurality of the spacers are provided and arranged in a vertically stacked orientation so as to surround substantially the entire height of the basket assembly.

In another embodiment, the invention can be an apparatus for transporting and/or storing radioactive materials having a residual heat load comprising: a tubular shell constructed of a gamma radiation shielding material and having an outer surface and an inner surface forming a cavity for receiving the radioactive materials; a base constructed of a gamma radiation shielding material, the tubular shell connected atop the base in a substantially vertical orientation, the cavity having an open top end and a closed bottom end; a plurality of ring-like structures constructed of a gamma radiation shielding material and having an inner surface, a top surface, and a bottom surface, the inner surface forming a central passageway that extends through the ring-like structure; the plurality of ring-like structures comprising a channel in either one of the top or bottom surfaces and a collar protruding from the other one of the top or bottom surfaces, the collar and the channel surrounding the central passageway; the plurality of ring-like structures comprising a series of voids for receiving a neutron radiation shielding material, the voids surrounding the central passageway; and the plurality of ring-like structures arranged in a stacked assembly so that the collars of the ring-like structures extend into the channel of an adjacent ring-like structure, the tubular shell extending through the central passageways of the plurality of ring-like structures.

In yet another embodiment, the invention can be an apparatus for providing neutron and gamma radiation shielding for radioactive materials that produce residual heat comprising: a ring-like body comprising a top surface, a bottom surface and an inner surface forming a central passageway that extends axially through the ring-like body; the ring-like body constructed of a gamma radiation shielding material and comprising a channel in either one of the top or bottom surfaces and a collar protruding from the other one of the top or bottom surfaces, the collar and the channel surrounding the central passageway; and the ring-like body comprising a series of voids for receiving a neutron radiation shielding material, the voids surrounding the central passageway.

In still another embodiment, the invention can be an apparatus for transporting and/or storing radioactive materials having a residual heat load comprising: a tubular shell constructed of a gamma radiation shielding material and having an outer surface and an inner surface forming a cavity for receiving the radioactive materials; a base constructed of a gamma radiation shielding material, the tubular shell connected atop the base in a substantially vertical orientation, the cavity having an open top end and a closed bottom end; a plurality of ring-like structures constructed of a gamma radiation absorbing material and having an inner surface, a top surface, and a bottom surface, the inner surface forming a central passageway through the ring-like structures; the plurality of ring-like structures arranged in a stacked assembly around the outside surface of the tubular shell so that a ring-to-ring interface is formed between the top and bottom surfaces of adjacent ring-like structures in the stacked assembly, the tubular shell extending through the central passageways of the plurality of ring-like structures; the plurality of ring-like structures adapted to provide neutron radiation shielding for radioactive materials in the cavity; and for each ring-to-ring interface present in the stacked assembly, a collar constructed of gamma radiation absorbing material surrounding the cavity at the ring-to-ring interface, the collar extending above and below the ring-to-ring interface.

In a further embodiment, the invention can be an apparatus for providing neutron and gamma radiation shielding for radioactive materials positioned in a cavity formed by an inner surface of a tubular shell having an outer surface and a height, the apparatus comprising: a ring-like body comprising a top surface, a bottom surface and an inner surface forming a central passageway that extends axially through the ring-like body, the central passageway sized to surround the outer surface of the tubular shell; the ring-like body constructed of a gamma radiation shielding material and comprising a collar protruding from either one of the top or bottom surfaces, the collar surrounding the central passageway; the ring-like body adapted so that when two of the ring-like bodies are aligned, the bottom surface of one of the ring-like passageways of the two ring-like bodies are aligned, the bottom surface of one of the ring-like bodies forms a ring-to-ring interface with the top surface of the other one of the ring-like bodies, and the collar of one of the ring-like bodies extending beyond the ring-to-ring interface.

In another aspect, the invention is based on a spacer apparatus that is designed to be positioned in the storage cavity of a container between the fuel basket assembly and the body of the container. Similar to the radiation shielding ring, the space device is also preferably a ring-like structure. However, its function and positioning within an HLW container is different.

The geometry of the spacer apparatus is specially designed to surround the fuel basket assembly and maintain the proper placement of the fuel basket within the storage cavity of the container. Additionally, the geometry and material of construction of the spacer apparatus maximizes the conduction of heat away from HLW positioned in the basket assembly. Furthermore, for ease of manufacturing and installation, the spacer apparatus can comprise a plurality of identical segments that are designed to be arranged in a stacked assembly that surrounds the entire height of the basket.

With respect to the spacer apparatus, the invention can take on a wide variety of embodiments. For example, the invention can be the spacer apparatus itself and/or a container that incorporates the spacer apparatus. In other examples, the invention can be a method of manufacturing the spacer apparatus or a method of manufacturing a container that utilizes the spacer apparatus. Still other examples include, a method of storing and cooling radioactive materials that produce a residual heat load and give off dangerous levels of neutron and gamma radiation. Some of these embodiments are outlined below with an understanding that those skilled in the art will understand that other embodiments of the invention are possible.

In one embodiment, the invention can be an apparatus for transporting and/or storing radioactive materials having a residual heat load, such as spent nuclear fuel rods, the apparatus comprising: a body comprising a shell having an inner surface that forms a cavity for receiving radioactive materials, the body providing gamma and neutron radiation shielding, the cavity having an open top end and a closed bottom end, the cavity having a horizontal cross-sectional profile having a perimeter formed by the inner surface of the shell; a basket positioned in the cavity, the basket comprising a plurality of substantially vertically oriented elongated cells, the basket having a horizontal cross-sectional profile having an external perimeter formed by an outer surface of the basket; and a structure having an outer surface and an inner surface forming a central passageway through the structure, the structure having a horizontal cross-sectional profile having an internal perimeter formed by the inner surface of the structure and an external perimeter formed by the outer surface of the structure; the structure positioned in the cavity, the basket extending through the central passageway of the structure; and wherein the internal perimeter of the structure corresponds to the external perimeter of the basket in size and shape and the external perimeter of the structure corresponds to the perimeter of the cavity in size and shape.

Preferably, the structure is constructed of a material having a first coefficient of thermal expansion and the shell is constructed of a material having a second coefficient of thermal expansion, the first coefficient of thermal expansion being greater than the second coefficient of thermal expansion. Designing the apparatus so that the first coefficient of thermal expansion is greater than the second coefficient of thermal expansion results in the structure expanding in size greater than the shell when heated. As a result, when a heat load is experienced by the apparatus (such as the cavity being loaded with HLW having a heat load), the structure expands to that its outer surface makes continuous contract with the inner surface of the shell. Similarly, the inner surface of the structure comes into continuous contact with the outer surface of the basket. Continuous contact between the surfaces facilitates improved conductive heat removal.

In a preferred embodiment, when the apparatus is at ambient temperature, a first small clearance exists between inner surface of the structure and the outer surface of the basket. However, upon radioactive materials having a residual heat load being positioned in the elongated cells of the basket, the residual heat load of the radioactive waste causes the basket and/or structure to expand, thereby eliminating the first small clearance. In other words, the basket and or structure expands so that the outer surface of the basket presses against the inner surface of the structure.

Similarly, when at ambient temperature it is preferred that a second small clearance exist between the outer surface of the structure and the inner surface of the shell that forms the cavity. As with the first small clearance, upon radioactive materials having the residual heat load being positioned in the elongated cells of the basket, the residual heat load of the radioactive waste causes the structure to expand at a rate and size greater than the shell, thereby eliminating the second small clearance. In other words, the structure expands so that the outer surface of the structure presses against the inner surface of the shell.

In a preferred embodiment, the structure comprises a plurality of non-unitary segments arranged in a stacked assembly that surrounds substantially the entire height of the basket. In a still further preferred embodiment, the apparatus can comprise one or more of the radiation shielding rings discussed above and/or any of the features discussed in relation thereto.

In another embodiment, the invention can be an apparatus for stabilizing a basket holding radioactive materials having a residual heat load within a cavity formed by the inner surface of a body portion of a container, the cavity having a horizontal cross-sectional profile having a perimeter formed by the inner surface of the body portion, the basket having a horizontal cross-sectional profile having an external perimeter formed by an outer surface of the basket, the apparatus comprising: a ring-like structure having an outer surface and an inner surface forming a central passageway, the ring-like structure having a horizontal cross-sectional profile having an internal perimeter formed by the inner surface of the ring-like structure and an external perimeter formed by the outer surface of the ring-like structure; and wherein the internal perimeter of the ring-like structure corresponds to the external perimeter of the basket in size and shape and the external perimeter of the structure corresponds to the perimeter of the cavity in size and shape.

In still another embodiment, the invention can be an apparatus for transporting and/or storing radioactive materials having a residual heat load, such as spend nuclear fuel rods, the apparatus comprising: a body comprising an inner surface that forms a cavity for receiving radioactive materials, the body providing gamma and neutron radiation shielding, the cavity having an open top end and a closed bottom end; a basket positioned in the cavity, the basket comprising a plurality of substantially vertically oriented elongated cells; a ring-like structure having an outer surface and an inner surface forming a central passageway, the basket extending through the central passageway of the ring-like structure; and wherein the ring-like structure is constructed of a material having a first coefficient of thermal expansion and the inner surface of the body constructed of a material having a second coefficient of thermal expansion, the first coefficient of thermal expansion being greater than the second coefficient of thermal expansion.

In yet another embodiment, the invention can be an apparatus for transporting and/or storing radioactive materials having a residual heat load, such as spent nuclear fuel rods, the apparatus comprising: a body portion having an inner surface that forms a cavity for receiving radioactive materials, the body portion providing gamma and neutron radiation shielding, the cavity having an open top end and a closed bottom end, the cavity having a horizontal cross-sectional profile having a perimeter formed by the inner surface of the body portion; a basket positioned in the cavity, the basket comprising a plurality of substantially vertically oriented elongated cells, the basket having a horizontal cross-sectional profile having an external perimeter formed by an outer surface of the basket; and a structure having an outer surface and an inner surface forming a central passageway, the structure having a horizontal cross-sectional profiled having an internal perimeter formed by the inner surface of the structure and an external perimeter formed by the outer surface of the structure: the structure positioned in the cavity, the basket extending through the central passageway of the structure; and wherein the internal perimeter of the structure corresponds to the external perimeter of the basket in size and shape and the external perimeter of the structure corresponds to the perimeter of the cavity in size and shape.

In a further embodiment, the invention can be an apparatus for transporting and/or storing radioactive materials having a residual heat load, such as spent nuclear fuel rods, the apparatus comprising: a body comprising a shell having an inner surface that forms a cavity for receiving radioactive materials, the body providing gamma and neutron radiation shielding, the cavity having an open top end and a closed bottom end; a basket positioned in the cavity and comprising a plurality of cells; a structure having an outer surface and an inner surface forming a central passageway, the basket extending through the central passageway of the structure; and wherein the structure is constructed of a material having a first coefficient of thermal expansion and the shell is constructed of a material having a second coefficient of thermal expansion, the first coefficient of thermal expansion being greater than the second coefficient of thermal expansion.

In a still further embodiment, the invention can be an apparatus for transporting and/or storing radioactive materials having a residual heat load, such as spent nuclear fuel rods, the apparatus comprising: a body portion having an inner surface that forms a cavity for receiving radioactive materials, the body portion providing gamma and neutron radiation shielding, the cavity having an open top end and a closed bottom end; a basket positioned in the cavity, the basket comprising a plurality of cells for receiving spent nuclear fuel rods, the basket having a horizontal cross-sectional profile having an external perimeter formed by an outer surface of the basket; and a structure having an outer surface and an inner surface forming a central passageway, the structure having a horizontal cross-sectional profile having an internal perimeter formed by the inner surface of the structure and an external perimeter formed by the outer surface of the surface; the structure positioned in the cavity between the basket and the inner surface of the body, the basket extending through the central passageway of the structure; wherein the internal perimeter of the structure corresponds to the external perimeter of the basket in shape and the external perimeter of the structure corresponds to the perimeter of the cavity in shape; and wherein when the structure is at ambient temperature, a small clearance exists between the outer surface of the structure and the inner surface of the body.

In an even further embodiment, the invention can be an apparatus for stabilizing a basket for holding radioactive materials having a residual heat load within a cavity formed by the inner surface of a body portion of a container, the apparatus comprising: a ring-like structure having an outer surface and an inner surface forming a central passageway adapted to receive the basket; and wherein the ring-like structure is constructed of a material having a first coefficient of thermal expansion and the inner surface of the body is constructed of a material having a second coefficient of thermal expansion, the first coefficient of thermal expansion being greater than the second coefficient of thermal expansion.

In yet another aspect, the focus of the invention is on a specially designed basket assembly for receiving and holding spend nuclear fuel rods. The basket assembly can be utilized in a multi-purpose canister or can be incorporated directly into the cavity of a container, such as a thermally conductive cask. With respect to the basket, the invention can take on a wide variety of embodiments. For example, the invention can be the basket itself and/or a container that utilizes the basket. In other examples of this aspect, the invention can be a method of manufacturing the basket of a method of manufacturing a container that utilizes the basket. Still other examples include, a method of storing and cooling radioactive materials. Some of these embodiments are outlined below with an understanding that those skilled in the art will understand that other embodiments of the invention are possible.

In one embodiment, the invention can be an apparatus suitable for transporting and/or storing spent nuclear fuel rods comprising: a basket formed from a honeycomb-like gridwork of plates arranged in a rectilinear configuration, the gridwork of plates forming a plurality of cells for receiving spent nuclear fuel rods: the basket comprising one or more flux traps that regulate production of neutron radiation; and wherein the plates are constructed of a metal matrix composite material.

The metal matrix composite material can be a metal ceramic that is high in Cr—$Al_2O_3$. Preferably, the basket has a height that is greater than or equal to a height of the spent nuclear fuel rods.

In a preferred embodiment, the basket is formed by a plurality of segments arranged in a stacked assembly wherein each segment comprising a honeycomb-like gridwork of plates arranged in the rectilinear configuration. Each segment can comprise a plurality of slots so that when the segments are arranged in the stacked assembly, the slots of each segment intersect with the slots of the adjacent segment. Preferably, the slots of the segments interlock the segments together so as to prohibit horizontal and rotational relative movement between the segments. More preferably, the basket comprises at least four of the segments all having substantially the same height.

In this embodiment, a bottom segment of the stacked assembly will preferably have a plurality of cut-outs in its plates that form passageways between the plurality of cells at or near a bottom of the cells. This acts as a bottom gas plenum. Similarly, a top segment of the stacked assembly will have a plurality of cut-outs in its plates that form passageways between the plurality of cells at or near a top of the cells. This acts as a top gas plenum. The cut-outs in the top and bottom segments can be semi-circular in shape. One or more downcomer passageways can be provided that extend from the top plenum to the bottom plenum for facilitating natural fluid circulation within the basket for facilitating convective cooling of spent nuclear fuel rods within the cells.

The plates are preferably slotted prior to assembly. Thus, they are adapted to be slidably assembled to form the basket. More specifically, when one plate is arranged at a 90 degree angle to a second plate, the slots of the two plates are aligned and intersect. The plates can comprise a plurality of slots in a top edge of the plates and a plurality of slots in a bottom edge of the plates that are aligned with the slots in the top edge. The slots on the top and bottom edge preferably extend one-fourth of the height of the plate. The plates can also comprise a tab extending from lateral edges of the plate, the tabs being one-half of the height of the plates. It is further preferred that the entire basket be formed of plates having no more than three different configurations. This reduces manufacturing costs and reduces the complexity of construction.

The one or more flux traps can be spaces formed between two of the plates. In one embodiment, at least two flux traps are provided that are substantially perpendicular to one another and extend the height of the basket. The spaces that are the flux traps can be formed between two substantially parallel plates.

When the basket assembly is incorporated into a canister, such as a multi-purpose canister, the inventive apparatus will further comprise a metal shell cylindrically encircling said basket; a metal base plate welded to the bottom of said metal shell; and a metal closure plate adapted to fit on top of the cylinder formed by said metal shell, thereby forming a canister.

However, if the basket assembly is to be incorporated into a storage container directly, the apparatus may further comprise a body having an inner surface that forms a cavity, the body adapted to provide neutron and gamma radiation shielding; and the basket positioned in the cavity in a substantially vertical orientation. The cavity can have an open top end and a closed bottom end. A lid can be positioned atop the body that encloses the open top end of the cavity. Preferably, the lid is a non-unitary structure with respect to the body. Most preferably, the cavity is hermetically sealed when the lid is positioned atop the body and the body is adapted to provide sufficient conductive heat removal for spent nuclear fuel rods placed within the basket to prevent a critical condition.

In this embodiment, the apparatus can further comprise any and/or all of the features discussed above with respect to the radiation shielding rings and/or the spacer apparatus.

In a further aspect, the invention can be an apparatus for transporting and/or storing radioactive materials comprising: a containment structure forming a cavity for receiving radioactive materials, the containment structure forming a containment boundary about the cavity; a plurality of ring-like structures, each of the ring-like structures comprising a top surface, a bottom surface and an inner surface forming a central passageway extending axially through the ring-like structure; the plurality of ring-like structures arranged in a stacked assembly so that a ring-to-ring interface is formed between the top and bottom surfaces of adjacent ring-like structures, the containment structure extending through the central passageways of the ring-like structures in the stacked assembly; and a collar located at each ring-to-ring interface and extending above and below the ring-to-ring interface.

In a still further aspect, the invention can be an apparatus for providing radiation shielding for radioactive materials enclosed in a particulate and fluidic containment boundary, the apparatus comprising: a ring-like body constructed of a gamma radiation shielding material, the ring-like body comprising a top surface, a bottom surface and an inner surface forming a central passageway; the ring-like body comprising a collar protruding from the top or bottom surfaces of the ring-like body; a series of voids in the ring-like body for receiving a neutron radiation shielding material, the voids surrounding the central passageway; and wherein when two of the ring-like bodies are stacked atop one another so as to form a ring-to-ring interface, the collar of one of the ring-like bodies extends beyond the ring-to-ring interface.

In another aspect, the invention is an apparatus for transporting and/or storing radioactive materials comprising: a containment structure forming a cavity for receiving radioactive materials, the containment structure forming a containment boundary about the cavity; a plurality of ring-like structures constructed of a gamma radiation absorbing material, each of the ring-like structures comprising a top surface, a bottom surface and an inner surface forming a central passageway extending axially through the ring-like structure; and each of the ring-like structures comprising a plurality of spaces for receiving a neutron radiation absorbing material, the spaces sized, shaped and/or arranged so that a linear path does not exist from an axis of the central passageways of the ring-like structures to an outer surface of the ring-like structures without passing through one or more of the spaces.

In still another aspect, the invention is an apparatus for providing radiation shielding for radioactive materials enclosed in a particulate and fluidic containment boundary, the apparatus comprising: a ring-like body constructed of a gamma radiation shielding material, the ring-like body comprising a top surface, a bottom surface and an inner surface forming a central passageway; the ring-like body comprising a plurality of voids in the ring-like body for receiving a neutron radiation shielding material; and wherein the plurality of spaces are sized, shaped and/or arranged so that a linear path does not exist from an axis of the central passageways of the ring-like structures to an outer surface of the ring-like structures without passing through one or more of the spaces.

In a still further aspect, the invention is an apparatus for transporting and/or storing radioactive materials having a residual heat load comprising: a body having an inner surface that forms a cavity for receiving radioactive materials, the body providing gamma and neutron radiation shielding, the cavity having an open top end and a closed bottom end, the cavity having a horizontal cross-sectional profile having a perimeter formed by the inner surface; a basket positioned in the cavity, the basket comprising a plurality of cells, the basket having a horizontal cross-sectional profile having an external perimeter formed by an outer surface of the basket; and a structure having an outer surface and an inner surface forming a central passageway, the structure having a horizontal cross-sectional profile having an internal perimeter formed by the inner surface of the structure and an external perimeter formed by the outer surface of the structure; the structure positioned in the cavity so that the basket extends through the central passageway of this structure; and wherein the internal perimeter of the structure corresponds to the external perimeter of the basket in size and shape and the external perimeter of the structure corresponds to the perimeter of the cavity in size and shape.

In another aspect, the invention is an apparatus for stabilizing a basket holding radioactive materials having a residual heat load within a cavity formed by the inner surface of a body portion of a container, the cavity having a horizontal cross-sectional profile having a perimeter formed by the inner surface of the body portion, the basket having a horizontal cross-sectional profile having an external perimeter formed by an outer surface of the basket, the apparatus comprising; a ring-like structure having an outer surface and inner surface forming a central passageway, the ring-like structure having a horizontal cross-sectional profile having an internal perimeter formed by the inner surface of the ring-like structure and external perimeter formed by the outer surface of the ring-like structure; and therein the internal perimeter of the ring-like structure corresponds to the external perimeter of the basket in size and shape and the external perimeter of the structure corresponds to the perimeter of the cavity in size and shape.

In yet another aspect, the invention can be an apparatus for transporting and/or storing radioactive materials having a residual heat load comprising: a body comprising an inner surface that forms a cavity for receiving radioactive materials, the body providing gamma and neutron radiation shielding, the cavity having an open top end and a closed bottom end; a basket positioned in the cavity and comprising a plurality of cells; a structure having an outer surface and an inner surface forming a central passageway, the basket extending through the central passageway of the structure; and wherein the structure is constructed of a material having a first coefficient of thermal expansion and the inner surface of the body constructed of a material having a second coefficient of thermal expansion, the first coefficient of thermal expansion being greater than the second coefficient of thermal expansion.

In a further aspect, the invention is an apparatus for stabilizing a basket for holding radioactive materials having a residual heat load within a cavity formed by the inner surface of a body portion of a container, the apparatus comprising: a ring-like structure having an outer surface and an inner surface forming a central passageway adapted to receive the basket; and wherein the ring-like structure is constructed of a material having a first coefficient of thermal expansion and the inner surface of the body is constructed of a material having a second coefficient of thermal expansion, the first coefficient of thermal expansion being greater than the second coefficient of thermal expansion.

In still a further aspect, the invention can be an apparatus suitable for transporting and/or storing spent nuclear fuel rods comprising: a basket formed from a honeycomb-like gridwork of plates arranged in a rectilinear configuration, the gridwork of plates forming a plurality of cells for receiving spent nuclear fuel rods; the basket comprising one or more flux traps that regulate production of neutron radiation; and wherein the plates are constructed of a metal matrix composite material.

DETAILED DESCRIPTION OF THE DRAWINGS

Figure 1:
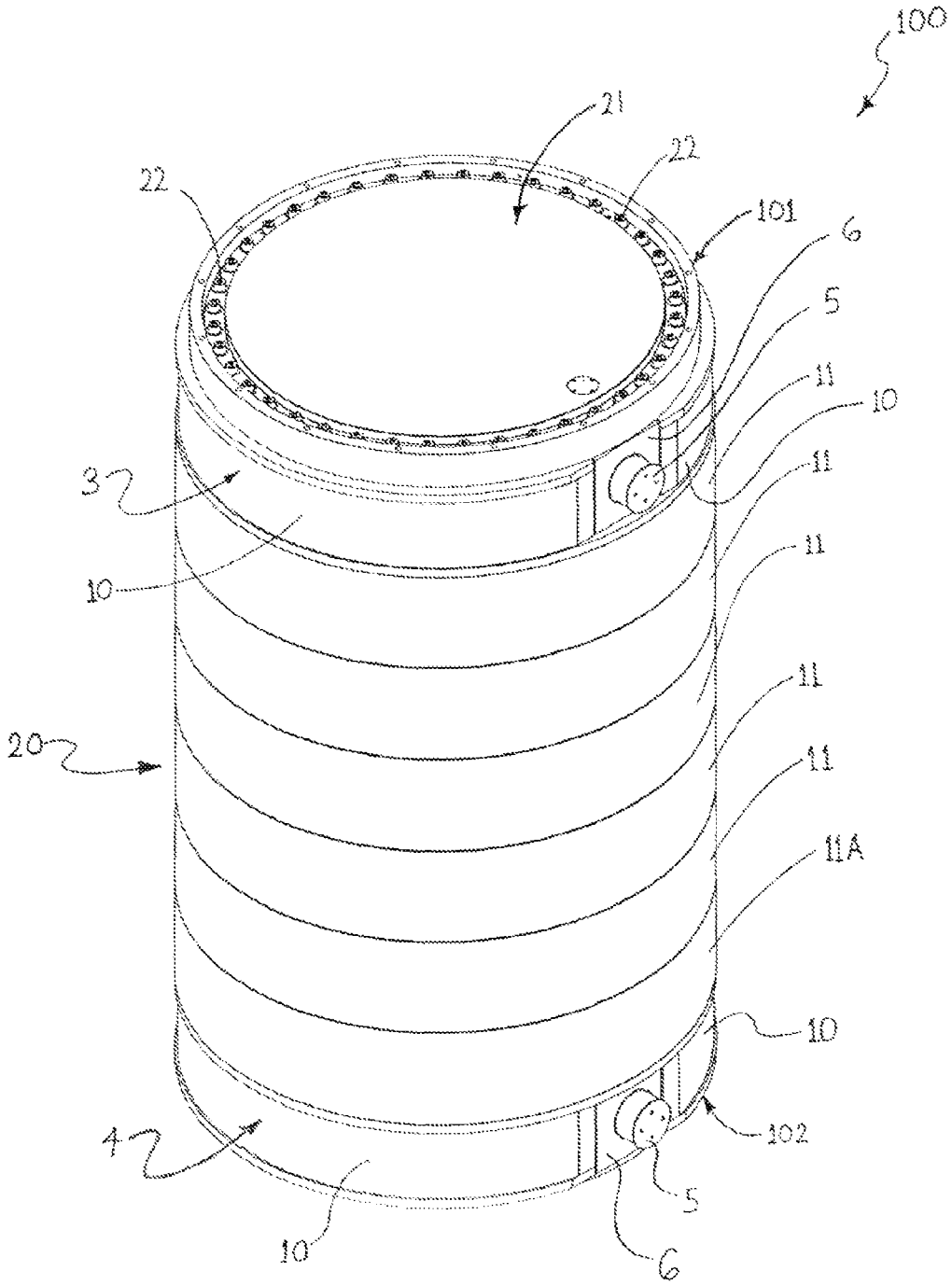
FIG. 1 is a perspective view of a container for storing and/or transporting HLW according to an embodiment of the present invention.

FIG. 1 is a perspective view of a container 100 for storing and/or transporting HLW according to an embodiment of the present invention. While the container 100 (and its components) are described throughout this specification in conjunction with storing and/or transporting SNF rods, the invention is in no way limited by the type of HLW. The container 100 (and its components) can be used to transport and/or store almost any type of high level radioactive waste. The container 100, however, is particularly suited to transport, store and/or cool radioactive materials that have a residual heat load and produce neutron and gamma radiation.

The container 100 is a thermally conductive cask and, thus, comprises a hermetically sealable cavity in which the SNF rods can be positioned for storage, cooling and/or transportation. In order to cool SNF rods that are located in the hermetically sealed cavity of the container 100, the residual heat emanating from the SNF rods is drawn away from the cavity by thermal conduction through the body 20 of the container 100. This conductive cooling process will be described in greater detail below. However, while the various aspects of the invention will be described in great detail with respect to a thermally conductive cask, those skilled in the art will appreciate that the inventive components and concepts can be incorporated into a VVO system if desired.

The container 100 is designed for use in a substantially vertical orientation (as shown in FIG. 1). The container 100 has a top 101 and a bottom 102. The container 100 is preferably a substantially cylindrical containment unit having a horizontal cross-sectional profile that is substantially circular in shape. The invention, however, is not limited by the shape of the container 100 or its intended orientation during use.

Figure 2:
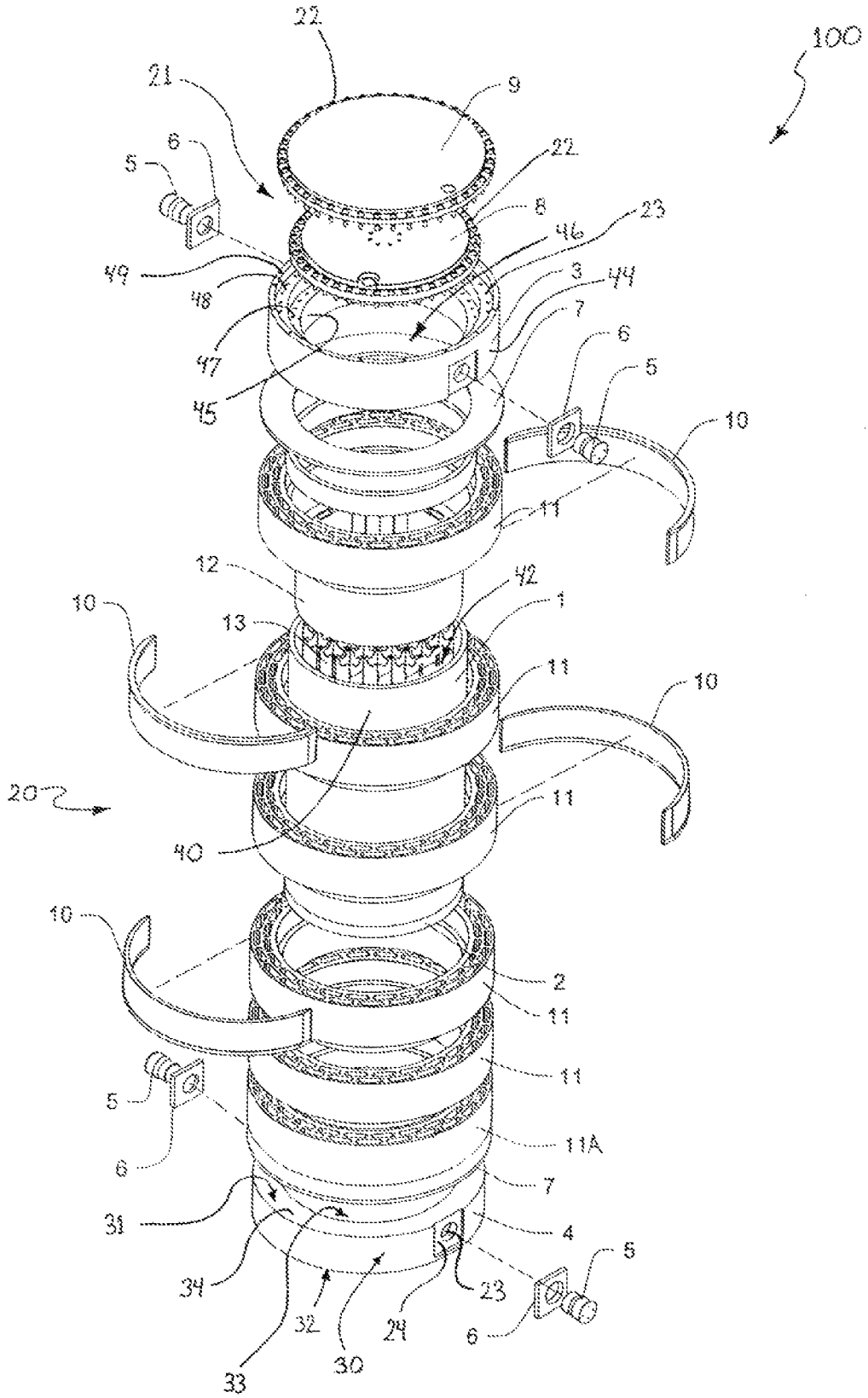
FIG. 2 is an exploded view of the container of FIG. 1.

The container 100 comprises a body portion 20 and a lid assembly 21, which comprises a primary lid 9 and a secondary lid 8 (visible in FIG. 2). Both the body portion 20 and the lid assembly 21 are constructed to provide effective neutron and gamma radiation shielding for radioactive materials that are stored in the container 100, especially SNF rods. As will be discussed in greater detail below, the design and manufacturing technique of the container 100 provides improved neutron and gamma radiation shielding over prior art containers.

The lid assembly 21 is connected to the body portion 20 via plurality of bolts 22. The lid assembly 21 is secured to the body portion 20 in a manner that allows the lid assembly 21 to be repetitively removed and secured to the body portion 20 without damaging the structural integrity of the container 100 or any of its components. Thus, the lid assembly 21 preferably forms a lid-to-body interface with the body portion 20 and is a non-unitary and removable structure with respect to the body portion 20.

The body portion 20 of the container 100 comprises a plurality of radiation shielding rings 11, 11A, a top forging 3 and a bottom forging 4. A pair of trunnions 5 are provided on each of the top and bottom forgings 3, 4 to facilitate handling of the container 100 with a crane or other means. More specifically, the trunnions 5 are positions on each of the top and bottom forgings 3, 4 so as to be circumferentially spaced from one another at approximately 180 degrees. The trunnions 5 are preferably made of a gamma radiation absorbing material that is sufficiently robust to handle the stresses and strains associated with the repetitive loading and unloading cycles undertaken during handling of the container 100. In one embodiment, the trunnions 5 are preferably formed of steel. Of course, other suitable materials can be used so long as they are of sufficient strength and adequate ductility so as to withstand the load bearing cycles.

A trunnion plate 6 is also provided at the base of each trunnion 5. The trunnion plates 6 are preferably rectangular in shape and have a hole that forms a passageway so that the trunnions 5 can extend therethrough. The trunnion plates 6 can be constructed of a gamma radiation absorbing material, such as steel. However, in instances where added neutron radiation shielding is needed for the top and bottom forgings 3, 4, the trunnion plates 6 can be constructed of a neutron radiation absorbing material. The desired structural and/or shielding properties of the container 100 will dictate the desired material of construction of the trunnion plates 6. The top and bottom forging 3, 4 have indentations 24 (visible in FIG. 2) for receiving the trunnion plates 6. The indentations 24 are sized and shaped to correspond to the size and shape of the trunnion plates 6.

The trunnions 5 can be connected to the top and bottom forgings 3, 4 by a wide variety of techniques, including without limitation, welding, bolting, a tight-fit assembly and threaded engagement. For container 100, suitably sized bores 23 (visible in FIG. 2) are formed into the outer surfaces of the top and bottom forgings 3, 4 at the desired locations for placement of the trunnions 5. The trunnions 5 are sized to fit within the bores 23 and protrude therefrom. Rigid engagement of the trunnions 5 within the bores 23 can be effectuated by any of the methods discussed above. However, threading engagement between the outer surfaces of the trunnions 5 and the inner surfaces of the bores 23 may be preferred. The bores 23 are located within the indentations 24.

Two neutron shielding plates 10 are secured to the outer surface of each of the top and bottom forgings 3, 4. The neutron shielding plates 10 are fitted between the trunnion plates 6 and are provided to improve the neutron radiation shielding properties of the forgings 3, 4 (which are primarily constructed of a gamma radiation absorbing material, such as steel). The neutron shielding plates 10 are constructed of a neutron radiation absorbing material, such as a polymer rich in hydrogen. Examples of such materials are sold under the name Hold-Tite and NSC4FR. The neutron shielding plates 10 are curved plate-like structures that are designed to circumferentially surround at least a portion of the outer surface of the top and bottom forgings 3, 4. Preferably, the entire outer surface of the top and bottom forgings 3, 4 are surrounded by a neutron absorbing material.

Referring now to FIG. 2, the general construction of the container 100 and the arrangement of its major component parts will be discussed in detail. FIG. 2 illustrates container 100 in an exploded state. The body portion 20 of the container 100 comprises the bottom forging 4. The bottom forging 4 acts as a base and/or foundation structure for the rest of the container 100. The bottom forging 4 is thick plate-like structure constructed of a gamma radiation absorbing material, such as steel or lead. However, other materials can be used if desired. The bottom forging 4 is designed to be sufficiently thick so that radiation does not escape from the bottom of the container 100 when loaded with radioactive materials, such as SNF rods. The exact thickness and material of construction of the bottom forging 4 will be determined on case-by-case design basis, taking into consideration such factors as the desired radiation shielding, government regulations, and the desired structural integrity. Additionally, while the base structure 4 of the container is referred to as a bottom "forging," the base structure 4 is not limited to any specific technique of formation/manufacture. The bottom forging 4 can be constructed by forging, machining, milling, lathing, molten metal molding, stamping, etc. or any combination thereof.

The bottom forging 4 comprises an outer surface 30, a top surface 31 and a bottom surface 32. The outer surface 30 acts as the side wall of the bottom forging 4 to which the neutron shielding plates 10 are attached. The top surface 31 of the bottom forging 4 comprises an indentation 33 formed by a raised edge portion 34. The indentation 33 forms an area for the inner shell 1 to nest. As a result, the indentation 33 facilitates the proper placement of the inner shell 1 atop the bottom forging 4. While the indentation 33 has a circular horizontal profile, the profile of the indentation 33 can take on a wide variety of shapes. However, it is preferable that the shape of the horizontal profile of the indentation 33 be substantially the same as the shape of the horizontal profile of the inner shell 1. The size of the horizontal profile of the indentation 33 is preferably slightly larger than that of the inner shell so that the bottom portion of the shell 1 can slidably fit therein so as to be supported in a substantially vertical orientation when the container 100 is assembled.

Figure 3:
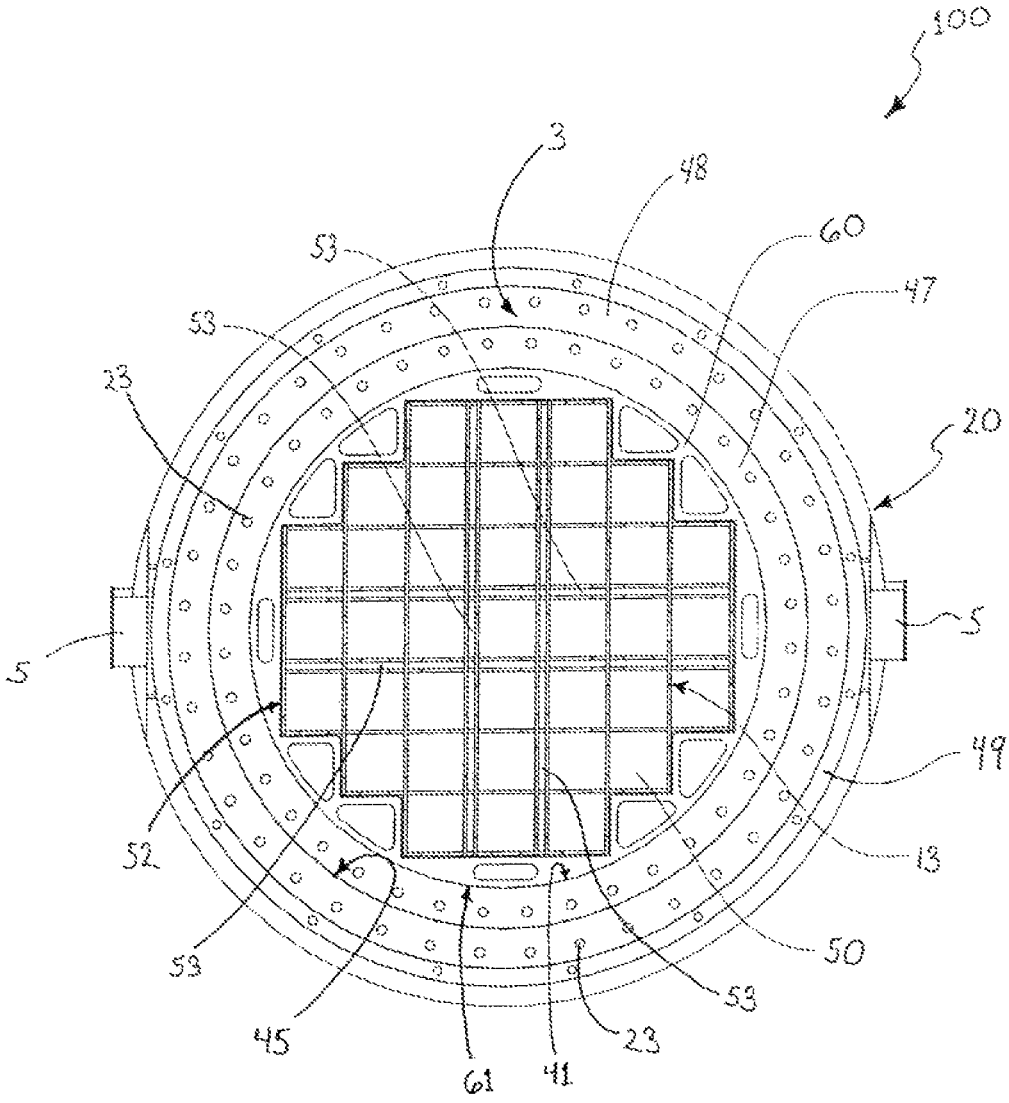
FIG. 3 is a top view of the container of FIG. 1 with the lid assembly removed.
Figure 4:
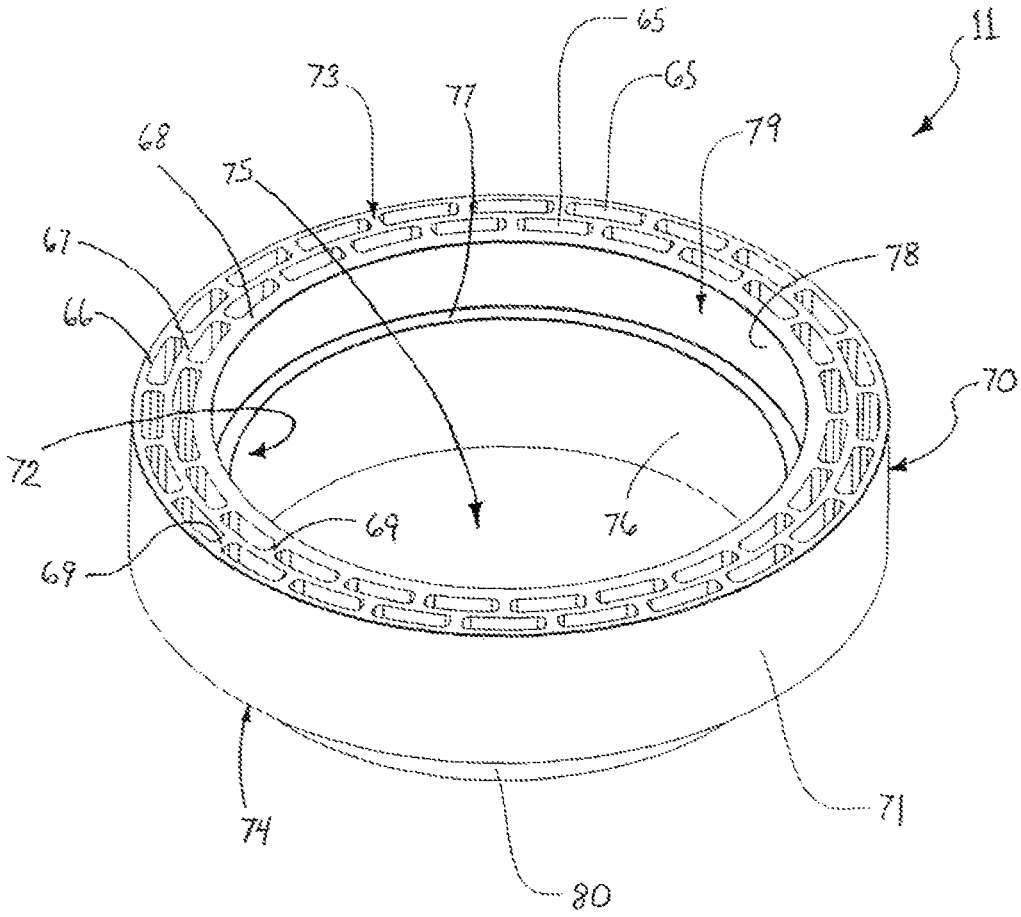
FIG. 4 is a front perspective view of a radiation shielding ring according to an embodiment of the present invention.
Figure 5:
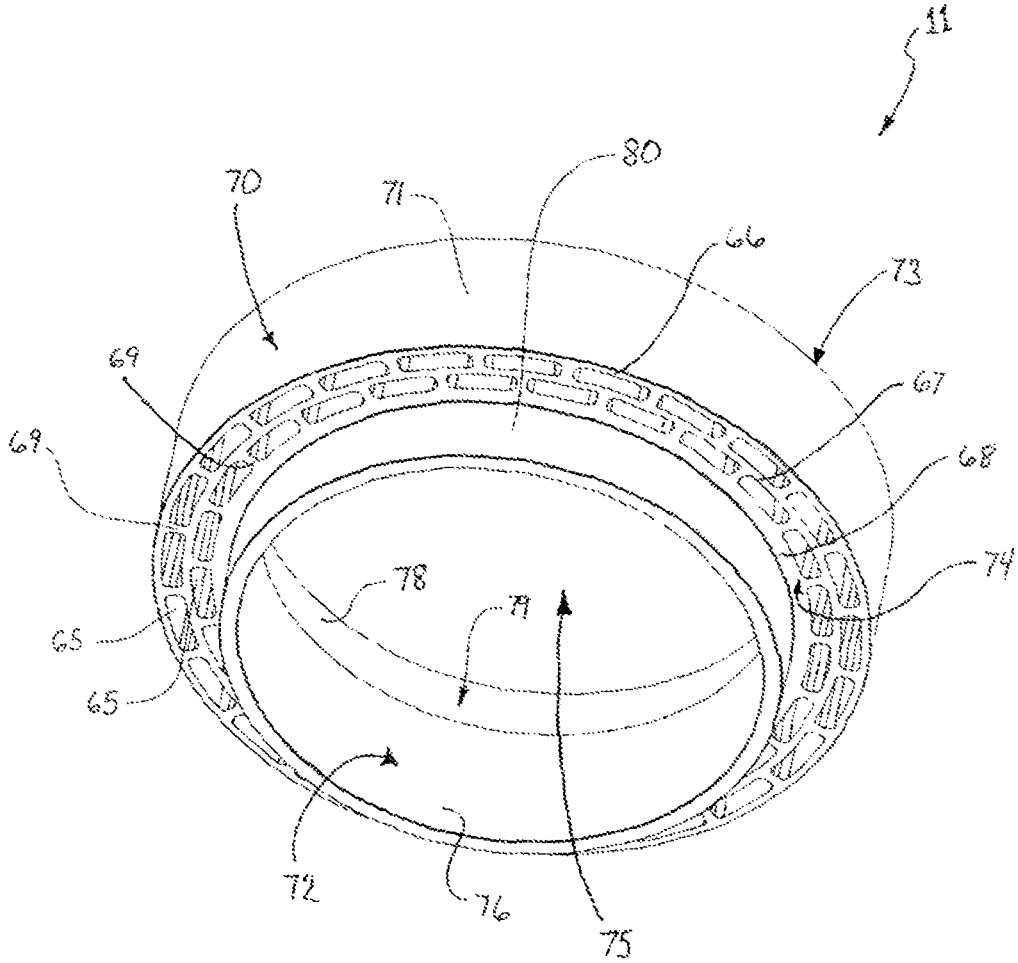
FIG. 5 is a bottom perspective view of the radiation shielding ring of FIG. 3.

The body portion 20 of the container 100 also comprises an inner shell 1 (fully visible in FIG. 3). The inner shell 1 is a thin-walled tubular structure. The inner shell 1 is generally cylindrical in shape and has a substantially circular horizontal cross-sectional profile. The inner shell 1 is preferably constructed of a gamma absorbing material, such as steel. However, in other embodiments the inner shell 1 can take on a wide variety of other shapes and be constructed of a host of other materials.

The inner shell 1 has an outer surface 40 and an inner surface 41 (labeled in FIG. 8) that forms a cavity 42 for receiving the radioactive materials that are to be stored, transported and/or cooled. The cavity 42 has an open top end and a closed bottom end. The open top end provides unobstructed access to the cavity 42. The inner shell 1 comprises a bottom plate 2 that is welded, bolted, riveted or otherwise secured to the bottom of the inner shell 1. The bottom plate 2 acts as a floor and encloses the bottom of the cavity 42. Preferably, the bottom plate 2 is made of the same material as the inner shell 1. As mentioned above, the inner shell 1 is positioned atop the bottom forging 4 in a substantially upright and vertical orientation when the container 100 is fully assembled. It should be noted that in certain embodiments of the invention, the body portion 20 may not comprise the inner shell 1. Instead, the cavity 42 will be formed directly into the body portion 20.

When the container 100 is fully assembled and loaded with SNF, a containment boundary is formed about the cavity 42. This containment boundary confines both particulate and fluidic matter within the cavity 42. As used herein, fluidic matter includes both gaseous matter and liquid matter. While the containment boundary is formed by the cooperation of the inner shell 1, bottom plate 2, top forging 3 and lids 8, 9 in the exemplified container 100, the invention is not so limited. The containment boundary can be formed by a single integral structure or any number of components/structures and combinations thereof so long as the particulate and fluidic containment function is achieved. For example, the containment boundary can be formed by a multipurpose canister or by the internal surfaces of the radiation shielding rings 11, 11A, the bottom forging 4, and lid 8.

The body portion 20 of the container 20 further comprises a plurality of radiation shielding rings 11, 11A. The radiation shielding rings 11, 11A are arranged in a stacked assembly that circumferentially surrounds the inner shell 1 and, thus, the cavity 42 formed therein. Preferably, the radiation shielding rings 11, 11A are stacked so as to surround the inner shell 1 for its entire height in a sleeve-like manner. The radiation shielding rings 11, 11A rest atop the upper surface of the raised ledge 34 of the bottom forging 4. Thus, in essence, the raided ledge portion 34 of the bottom forging 4 acts a flange.

The radiation shielding rings 11, 11A are adapted to provide the bulk of the necessary neutron and gamma radiation shielding in the lateral direction for radioactive materials stored in the cavity 42. The radiation shielding rings 11, 11A also form the outer portion of the container 100 and provide an excellent conductive heat removal path. Of course, the inner shell 1 also provides some of the necessary gamma radiation shielding. The rings 11, 11A also provide the structural boundary to protect the container 100 from incidental damage. The stacked assembly of the radiation shielding rings 11, 11A and the interaction of the radiation shielding rings 11, 11A with one another and the inner shell 1 will be discussed at length below with respect to FIGS. 6-8.

Referring still to FIG. 2, a total of six radiation shielding rings 11, 11A are used to form the stacked assembly around the inner shell 1 in the illustrated embodiment. However, depending on the height of the container 100 desired, more or less radiation shielding rings 11, 11A can be used. It is preferable that at least three radiation shielding rings 11, 11A be implemented in order to facilitate ease of assembly and sliding over the inner shell 1. The radiation shielding rings 11, 11A are identical to one another with the exception that the bottom-most radiation shielding ring 11A, which acts as an end component in the stack, does not have a collar extending/protruding from its bottom surface. This will described in greater detail below. Using a plurality of identical radiation shielding rings 11, 11A to form the body portion 20 of the container 100 allows a manufacturer to create containers having a multitude of different heights with minimal retooling.

Two end plates 7 are provided at the top and bottom of the stacked assembly of radiation shielding rings 11, 11A. The end plates 7 are flat ring-like plate structures that resemble a disc having a center hole. As with the radiation shielding rings 11, 11A, the end plates 7 circumferentially surround the inner shell 1 (and thus the cavity 42 formed thereby). The inner shell 1 extends through the center hole of the end plates 7. One end plate is positioned below the bottom-most radiation shielding ring 11A, thus being located between the bottom surface of the radiation shielding ring 11A and the upper surface of the raided ledge portion 34 of the bottom forging 4. The other end plate 7 is positioned above the upper-most radiation shielding ring 11, thus being located between the top surface of the upper-most radiation shielding ring 11 and the bottom surface of the top forging 3. The end plates 7 enclose the voids/pockets 65 of the radiation shielding rings 11, 11A that hold the neutron radiation absorbing material (discussed below). Suitable welds or other connection methods can be employed as necessary to connect the end plates 7 to the radiation shielding rings 11, 11A and the top and bottom forgings 3, 4. Preferably, the end plates 7 are connected to the radiation shielding rings 7 in a manner that hermetically seals the pockets/voids, such as welding or through the use of a gasket.

The body portion 20 of the container 100 also comprises a top forging 3. The top forging 3 is a thick ring-like structure constructed of a gamma radiation absorbing material, such as steel or lead. The top forging 4 is designed to be sufficiently thick so as to provide the necessary radiation shielding properties for the radioactive materials stored in the cavity 42. Other materials can be used if desired. As with the bottom forging 4, the top forging 3 can be constructed by any suitable technique, including forging, machining, milling, lathing, molten metal molding, stamping, etc. or any combination thereof.

The top forging 3 is positioned atop and connected to the stacked assembly of radiation shielding rings 11, 11A. In order to allow access to the cavity 42 for the loading and unloading of radioactive materials, the top forging 3 is constructed as a ring-like structure having an outer surface 44 inner surface 45 that forms a passageway 46 through the top forging. The top forging 3 is positioned atop the inner shell 1 and the stack assembly of the radiation shielding structures 11, 11A so that the passageway 46 is aligned with the open to end of the cavity 42 of the inner shell 1.

The top forging 3 also serves to act as a structure by which the primary and secondary lids 9, 8 can be secured to the body portion 20 of the container 100. The top forging 3 comprises a first ledge 47 and second ledge 48 that surrounds the passageway 46. The ledges 47, 48 are formed by the stepped nature of the inner surface 45. The first ledge 47 is formed by the horizontal surface atop the first riser portion of the inner surface 45. The second ledge 48 is formed by the horizontal surface atop the second riser portion of the inner surface 45. Thus, the second riser portion of the inner surface 45 provides lateral restraint for the secondary lid 8. A retaining ridge 49 surrounds the second ledge and provides lateral restraint for the primary lid 9.

The first and second ledges 47, 48 comprise a plurality of spaced apart bores 23. The bores 23 acts as receiving holes for the bolts 22 that are used to secure the primary and secondary lids 9, 8 to the body portion 20 of the container 100. If desired, the bores 23 can have a threaded wall surface for engagement with the threads of the bolts 22. Of course, the primary and secondary lids 9, 8 can be secured to the body portion 20 of the container 100 by any means known in the art, including, without limitation, riveting, screwing, a tight-fit assembly, or a combination thereof.

The secondary lid 8 is smaller in size than the primary lid 9. The primary lid 8 rests on the first ledge 47 of the top forging 3 and is bolted thereto. The secondary lid 9 rests on a second ledge 48 of the top forging 3 and is bolted thereto. When secured to the body portion 20 of the container in their intended orientation, a space if formed between the primary lid 9 and the secondary lid 8. The primary and secondary lids 8, 9 are preferably constructed of thick steel or another metal. Lead can be used. If desired, the secondary lid 8 can comprise an adequate amount of neutron radiation absorbing material. Together, the primary and secondary lids 9, 8 provide the necessary radiation shielding properties for the top of the container 100 so that radiation does not escape upward from the cavity 42.

With reference to FIGS. 2 and 3 simultaneously, the basket 13 and spacers 60 of the container 100 will be generally described. The container 100 further comprises and SNF storage basket 13 and a plurality of spacers 60. The basket 13 is centrally positioned within the cavity 42 of the inner shell 1 and rests on the floor of the cavity 42 that is formed by bottom plate 2. The basket 13 is positioned in the cavity 42 in a substantially vertical orientation and is preferably free-standing. The basket 13 comprises a plurality of vertically-oriented elongated storage cells 50 that are designed to receive SNF rods. Each cell 50 is a space that is designed to fully accommodate a single SNF rod. The basket also comprises a plurality of flux traps 53. The basket 13 will be discussed in greater detail with respect to FIGS. 15-17 below.

Referring still to FIGS. 2 and 3, the spacers 50 are arranged in the cavity 42 in a stacked assembly that surrounds the outer perimeter of the basket 13. The basket 13 extends through the central passageways 165 of the spacers 60. A sufficient number of spacers 60 are stacked atop one another so that the entire height of the basket 13 is surrounded. Preferably, more than three spacers are used for a single container 100. In an alternative embodiment, the spacer 60 can be constructed as single integral structure that is tall enough to surround the entire height of the basket 13 rather than a plurality of non-unitary segments.

The spacers 60 support, position and orient the basket 13 within the cavity 42. The spacers 60 are located between the inner surface 41 of the inner shell 1 and the outer surface 52 of the basket 13. The spacers 60 are preferably made of a material that has a coefficient of thermal expansion that is greater than that of the material of which the inner shell 1 is constructed. More preferably, the spacers 50 are constructed of a material having a coefficient of thermal expansion that is greater than that of the materials of which all of the components of the container 100 are constructed, including without limitation the radiation shielding rings 11, 11A, the basket 13 and the forgings 3, 4. By constructing the spacers 60 out of material that has a greater coefficient of thermal expansion than that of the inner shell 1, continuous contact between the outer surface 61 of the spacers 60 and the inner surface 41 of the inner shell 1 when experiencing a heat load. Continuous surface contact improves the ability of the heat emanating from the radioactive waste to conduct outwardly through the body portion 20 of the container 100. In one embodiment, the spacer 60 is made of aluminum and the inner shell 1 is made of steel. The spacers 60 and their functioning will be discussed in greater detail below with respect to FIGS. 10-14.

Referring now to FIGS. 4-6A contemporaneously, the structure of the radiation shielding rings 11 will be described in detail. The radiation shielding ring 11 is a circular ring-like structure. While the ring-like structure 11 has substantially circular horizontal profile in the illustrated embodiment, the radiation shielding ring 11 is not so limited. In other embodiment, the ring-like structure 11 can have a rectangular or other geometric profile. The radiation shielding ring 11 has a ring body 70 having an outer surface 71, an inner surface 72, a top surface 73 and a bottom surface 74.

The inner surface 72 forms a central passageway 75 that extends through the radiation shielding ring 11. The dimensions of the central passageway 75 are dictated by the dimensions of the inner shell 1 and the material of which the ring body 70 is constructed. The inner surface 72 is preferably a stepped surface comprising a first riser surface 76, a horizontal tread surface 77 and a second riser surface 78. The stepped inner surface 72 forms an annular channel 79 in the top surface 73 above the horizontal tread surface 77. The channel 79 circumferentially surrounds the central passageway 75.

If desired, the outer surface 71 of the radiation shielding ring 11 can be modified to increase the overall area exposed to the ambient surrounding to increase heat removal via convection. For example, the outer surface can be undulating, threaded, dimpled or contain spines.

The radiation shielding ring 11 further comprises a collar 80 protruding from the bottom surface 74 of the ring body 70. The collar 80 is a plate-like structure that forms a ridge extending from the bottom surface 74 of the ring body 70. The collar 80 circumferentially surrounds the central passageway 75 in manner that correspond to the channel 79. The collar 80 can be integrally formed as part of the ring body 70 or can be a non-unitary structure that is secured to the ring body via welding, bolting or any other connection technique. In the illustrated embodiment, the collar 80 is integrally formed as part of the ring body 70.

In the illustrated embodiment of the radiation shielding ring 11, the collar 80 is located adjacent the central passageway 75 so that the collar 80 comprises the first riser surface 76 of the inner surface 72. The collar 80, however, can be located on the ring body 70 at a radially spaced location from the central passageway 75 if desired, such as near the outer surface 71 of the ring body 70. Moreover, in some embodiments, the collar 80 can be located on the top surface 73 of the ring body 70. In such embodiments, the channel 79 will be located in the bottom surface 74 of the ring bodies 70 rather than in the top surfaces 73.

Figure 6A:
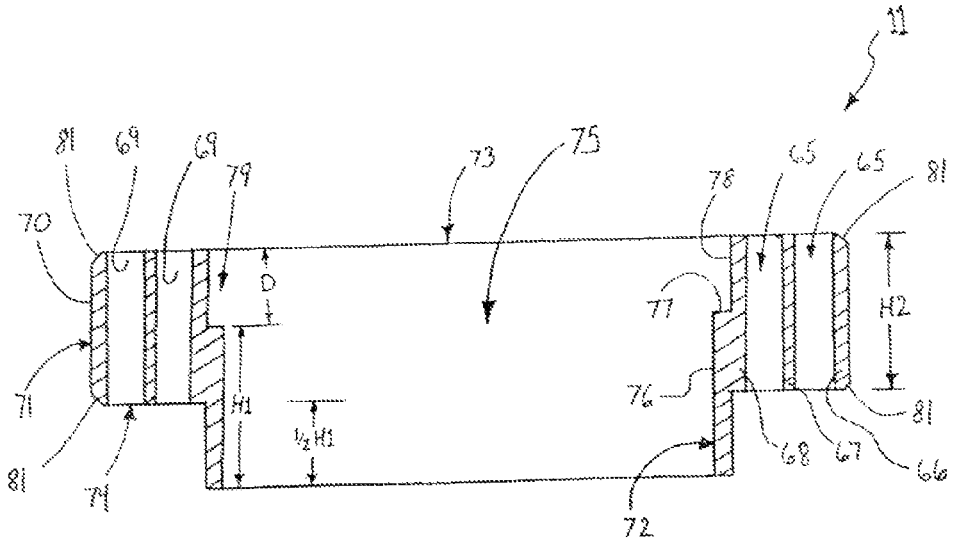
FIG. 6A is a vertical cross-sectional view of the radiation shielding ring of FIG. 3.

Referring solely to FIG. 6A, the collar 80 has a height H1 that is substantially equal to the height H2 of the ring body 70. The collar 80 is connected to the ring body 70 so that approximately one-half of its height H1 protrudes beyond the bottom surface 74 of the ring body 70. As a result, the channel 79 has a depth D that is approximately one-half of the height H1 The importance of these dimensions will become apparent from the discussion below with respect to FIGS. 7 and 8 regarding the stacked assembly and the interaction between adjacent radiation shielding rings 11.

The top and bottom surfaces 73, 74 of each ring 11 are chamfered near the outer perimeter so as to form chamfered surfaces 81. When arranged in the stacked assembly, the chamfered surfaces 81 of the adjacent radiation shielding rings 11 for a circumferential groove in the outer surface of the retainer 100. This circumferential groove allows seal welding of adjacent rings 11 in the stacked assembly, which helps keep the container 100 water tight when it is placed in a spent fuel pool.

Referring again to FIGS. 4-6A contemporaneously, the radiation shielding rings 11 comprise a plurality of voids 65. In order to avoid clutter, only a few of the voids 65 are numerically identified in the drawings. The voids 65 are provided for receiving a neutron radiation absorbing material, such as a solidifying liquid that is poured into each void 65. Such solidifying liquids are well known in the art. Other suitable neutron radiation absorbing materials include water and other materials that are rich in hydrogen. Each void 65 extends from the top surface 73 to the bottom surface 74, thereby forming a vertical passageway through the ring body 70 of the radiation shielding ring 11. When container 100 is fully constructed, the voids 65 are filled with the neutron absorbing material.

The voids 65 are arranged in a series of two concentric rings surrounding the central passageway 75. Importantly, the voids 65 of the inner ring series are circumferentially offset from the voids 65 of the outer ring series. This configuration ensures that the neutron radiation shielding material surrounds the central passageway 75 without any gaps in the neutron radiation shielding that is provided. The offset/juxtaposition of the voids 65 of the inner and outer ring series eliminates the existence of liner path from the central passageway 75 to the outer surface 71 of the radiation shielding ring 11 that does not pass through the neutron radiation absorbing material in the voids 65. In other words, a linear path does not exist through the material of which the radiation shielding ring 11 is constructed. Such a linear path is undesirable because the material of the radiation shielding ring 11, which will typically be a gamma radiation absorbing metal, does not by itself provide the necessary neutron radiation shielding properties. As a result, areas of high neutron radiation exposure (i.e., streaming would result if such a linear path was allowed to exist. The dual series design and the offset/juxtaposition of the voids 65 of the inner and outer ring series eliminates this issue.

The geometric design/layout of the voids 65 also serves another important purpose. The geometric layout of the voids 65 ensures that when the radiation shielding rings 11, 11A are arranged in a stacked assembly around the inner shell 1, all of the voids 65 of the radiation shielding rings 11, 11A are in spatial communication with all of the voids of the adjacent radiation shielding ring(s) 11, 11A, irrespective of the circumferential orientation (i.e., rotational position) of the radiation shielding rings 11, 11A. As a result, the neutron absorbing material can be flowed into the voids 65 of the uppermost radiation shielding ring 11 in the stacked assembly and flow freely into all of the voids 65 of the remaining radiation shielding rings 11, 11A in the stacked assembly. Thus, one does not have to worry about the circumferential/rotational orientation of the radiation shielding rings 11, 11A with respect to one another during this pouring process. It should be noted that the two rings/series of voids 65 could be spatially interconnected in places to facilitate the pouring of the neutron shielding material during construction.

The ring body 70 of the radiation shielding ring 11 further comprises an outer wall 66, a middle wall 67 and an inner wall 68 (best visible in FIG. 6A). The walls 66-68 are in a spaced and concentric relation with respect to one another. The first inner-ring series of voids 65 are located between the inner wall 68 and the middle wall 67. The second outer-ring series of voids 65 is located between the outer wall 66 and the middle wall 67.

Radial fins 69 are provided that form structural connections between the walls 66-68 and function to remove heat. A first series/plurality of radial fins 69 connect the inner wall 68 to the middle wall 67. A second series/plurality of radial fins 69 connect the middle wall 67 to the outer wall 66. The radial fins 69 facilitate the cooling of the radioactive waste stored in the container 100 by conducting heat through the radiation shielding ring 11 and away from the radioactive waste. More specifically, the radial fins 69 provide a heat removal path that ensures adequate heat conduction from the inner wall 68 to the outer wall 66 where convective forces can then remove the heat load from the outer surface 71 of the ring body 70.

Importantly, the radial fins 69 of the first series are circumferentially offset from the radial fins 69 of the second series. This offset/juxtaposition of the radial fins 69 eliminates the existence of a linear path existing from the central passageway 75 to the ambient atmosphere through the material of the radiation shielding ring 11. Thus, neutron radiation exposure (i.e., streaming) through the radiation shielding ring 11 itself is eliminated.

Figure 6B:
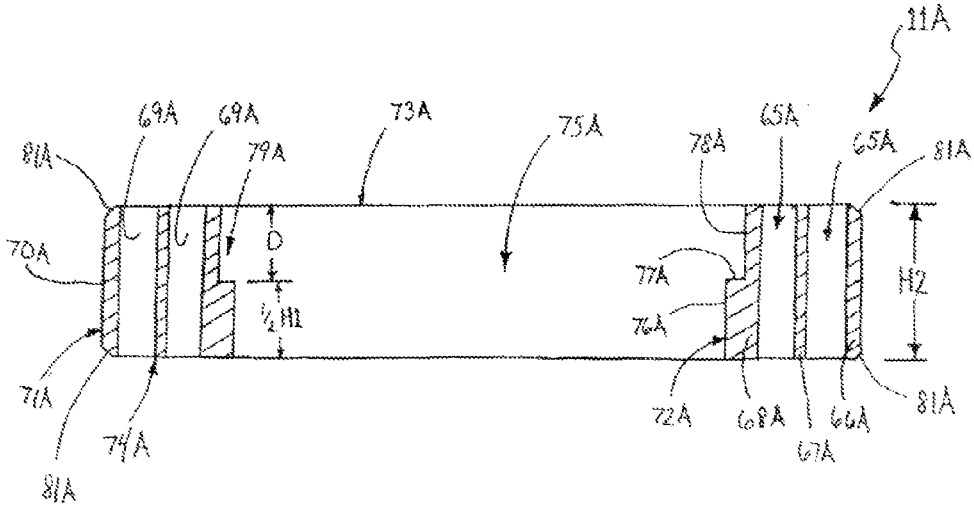
FIG. 6B is a vertical cross-sectional view of the end radiation shielding ring according to an embodiment of the invention.

Referring now to FIG. 6B, an end radiation shielding ring 11A is illustrated. In order to avoid redundancy, only those aspects of the end radiation shielding ring 11A that differ from the radiation shielding ring 11 will be discussed. Like numbers are used to identify like elements with the addition of the letter "A" as a suffix. The end radiation shielding ring 11A is identical to the radiation shielding rings 11 except that it does not have a collar. The collar is omitted from the end radiation shielding ring 11A so that the bottom surface 74A of the ring body 70A can rest flushly atop the end plate 7 (FIG. 2) when the stacked assembly is formed. The presence of a collar would prevent this. However, if the bottom forging 4 had a channel formed therein to receive a collar, the end radiation shielding ring 11A could have such a collar. Finally, while the end radiation shielding ring 11A is the bottom-most ring in the stacked assembly, it may also be the upper-most ring in the stacked assembly if desired.

Figure 7:
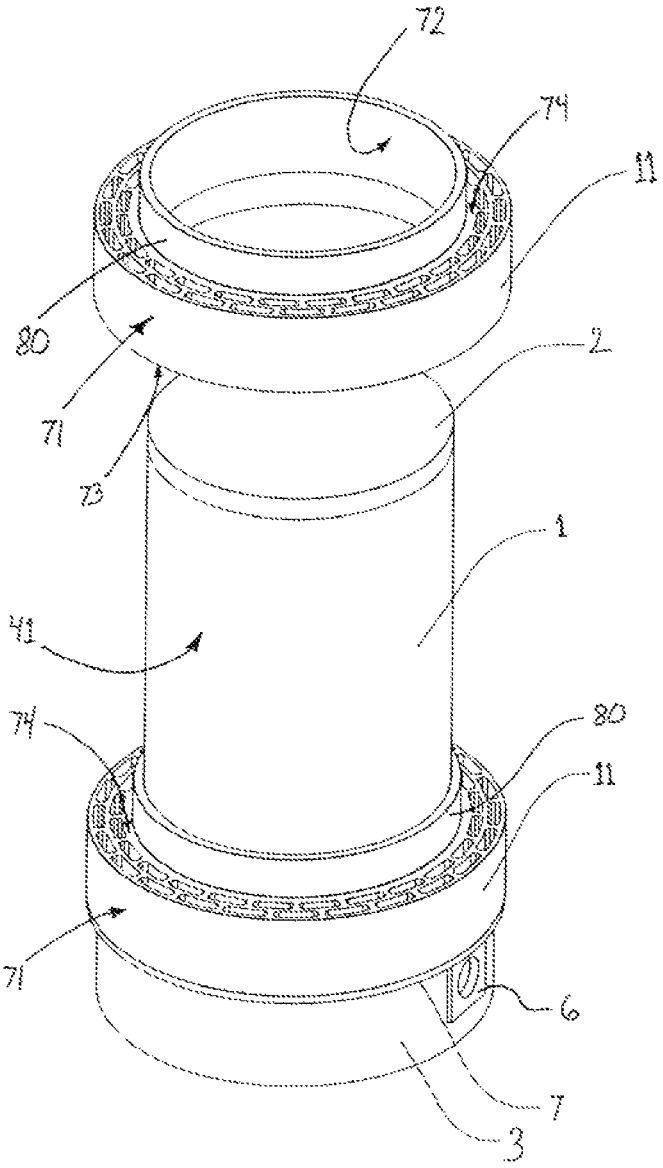
FIG. 7 is a perspective view of an early stage of construction of the container of FIG. 1 wherein the radiation shielding rings are being fitted over the inner shell in a heated state.

Referring now to FIG. 7, the installation of the radiation shielding rings 11, 11A over the inner shell 1 during the manufacture of the container 100 will be described. First, the top forging 3 is provided. The end plate 7 is then connected to the bottom surface of the top forging 3. The inner shell 1 (comprising the bottom plate 2) is then connected to the assembly of the top forging 3 and the end plate 7 so that the open end of the cavity 42 is accessible through the top forging 3 via its open top end. The connections can be accomplished through welding or the like.

The assembly of the inner shell 1, the top forging 3 and the end plate 7 is then oriented in an upside-down position. The assembly is now ready for the installation of the radiation shielding rings 11, 11A. However, in order to optimize heat removal (i.e., cooling) from radioactive materials loaded in the cavity 42 of the inner shell 1, it is desired that the inner surfaces 72 of the radiation shielding rings 11, 11A be in substantially continuous surface contact with the outer surface 40 of the inner shell 1. Even the smallest of gaps and or voids between these surfaces will negatively affect the ability of heat to conduct outwardly from the radioactive waste to the outer surfaces 71 of the radiation shielding rings 11, 11A (where it can be removed by convective forces). Thus, a very tight and flush fit between the inner surfaces 72 of the radiation shielding rings 11 and the outer surface 40 of the inner shell 1 is desired.

The present invention achieves this tight and flush fit between the surfaces 40 and 72 by utilizing the phenomena of thermal expansion. As discussed above, the radiation shielding rings 11, 11A are preferably made of a metal, such as steel. Thus, through the phenomena of thermal expansion, the dimensions of the radiation shielding rings 11, 11A are varied/adjusted by heating and/or cooling of the structure. The radiation shielding rings 11 are designed so that: (1) when the radiation shielding rings 11, 11A and the inner shell 1 are at substantially the same temperature (such as ambient temperature), the horizontal cross-sections of the central passageways 75 are slightly smaller than or equal to the horizontal cross-section of the outer surface 40 of the inner shell 1; and (2) when the radiation shielding rings 11, 11A are super-heated to a desired temperature that is greater than the temperature of the inner shell 1, the horizontal cross-section of the central passageways 75 are slightly larger than the horizontal cross-section of the outer surface 40 of the inner shell 1.

The present invention utilized this key design feature to effectuate the installation of the radiation shielding rings 11, 11A about the inner shell 1 in the stacked assembly. More specifically, once the assembly of the inner shell 1, the top forging 3 and the end plate 7 are oriented in the illustrated upside-down position, a first radiation shielding ring 11 is super-heated to a temperature that results in the horizontal cross-section of the outer surface 40 of the inner shell 1. In one embodiment, the radiation shielding ring 11A is preferably heated to a temperature less than 600 degrees Fahrenheit Celsius. Importantly, the superheating should be controlled so as to not reach a temperature that would affect the metallurgical properties of the material of which the radiation shielding rings 11, 11A are constructed. The inner shell 1 is maintained at ambient temperature at this time. Once the first radiation shielding ring 11 is adequately heated and, thus, in an expanded state, the radiation shielding ring 11 is oriented upside-down. When upside-down, the top surface 73 of the first radiation shielding ring 11 is oriented downward and the collar 80 is oriented upward.

The central axis of central passageway 75 of the first radiation shielding ring 11 is then aligned with the central axis of the inner shell 1 and slid downward over the inner shell 1. As the first radiation shielding ring 1 is slid downward, the inner shell 1 extends through the central passageway 75 of the radiation shielding ring 11. Because the first radiation shielding ring 11 remains heated (and thus expanded) during this installation procedure, a small annular gap/space 82 (visible in FIG. 8) exists between inner surface 72 of the radiation shielding ring 11 and the outer surface 40 of the inner shell 1. This annular gap/space 82 acts a tolerance that allows the first radiation shielding ring 11 is slidably lowered until its top surface 73 rests atop of the end plate 7. As the first radiation shielding ring 11 cools, it will shrink in size, thereby effectuating a very tight fit between the inner surface 72 of the radiation shielding ring 11 and the outer 40 surface of the inner shell 11 that is free of gaps and/or voids (i.e., substantially continuous surface contact). The inner surface 72 of the first radiation shielding ring 11 preferably compresses the outer surface 40 of the inner shell 1.

Once the first (and upper-most) radiation shielding ring 11 is in place, this heat-up and installation procedure is repeated for the remaining radiation shielding rings 11, 11A until the entire height of the inner shell 1 surrounded by a stacked assembly of the radiation shielding rings 11, 11A.

Figure 8:
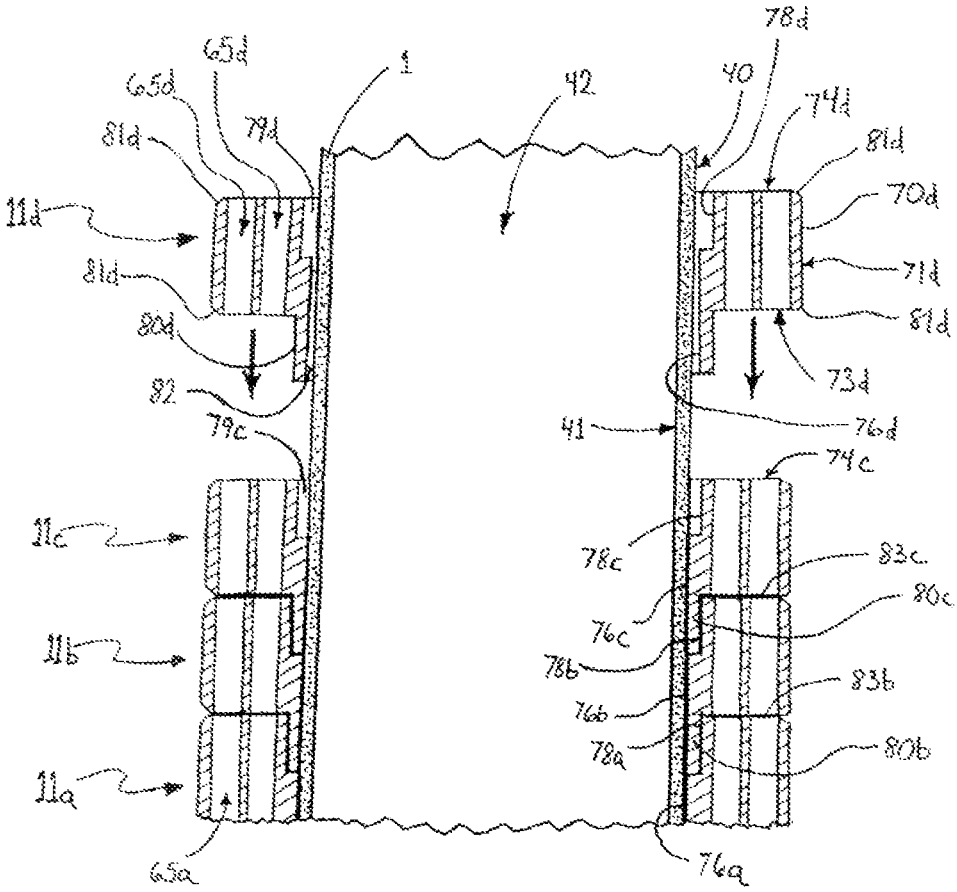
FIG. 8 is a vertical cross-sectional view of a portion of the body of the container of FIG. 1 wherein the radiation shielding rings are in the process of being fitted over the inner shell.

Referring now to FIG. 8, the creation of the stacked assembly of the radiation shielding rings 11*a*-*d* will be described in greater detail. For ease of reference, the radiation shielding rings 11 have been given an alphabetical suffix "a" through "d". For further ease of reference, the stacked assembly is illustrated as being created in the upright position rather than the upside-down position of FIG. 7. The discussion, however, can easily be applied to the upside-down installation described in FIG. 7. In FIG. 8, three radiation shielding rings 11*a*-11*c* are already installed in a stacked arrangement about the outer surface 40 of the inner shell 1 for positioning atop the stacked assembly. The radiation shielding ring 11*d* is in the super-heated state while the radiation shielding rings 11*a*-11*c* are in a cooled/ambient state.

Because the radiation shielding ring 11*d* is in the super-heated state, the radiation shielding ring 11*d* is expanded in size. A small annular gap 82 exists between the first riser surface 76*d* (of the inner surface 72*a*) of the radiation shielding 11*d* and the outer surface 40 of the inner shell 1. The invention, however, is not limited to any size or shape for the gap 82. The annular gap 82 preferably provides the minimum clearance necessary to allow the radiation shielding ring 11*d* to slide over the inner shell 1. When the radiation shielding ring 11*d* cools, it will shrink, as have radiation shielding rings 11*a-c*. Upon cooling from their super-heated states, first riser surfaces 76*a-d* of the radiation shielding rings 11*a-d* will compress against the outer surface 40 of the inner shell 1, thereby creating substantially continuous surface contact therebetween. In order to eliminate the formation of any gaps/spaces between the inner surfaces 72*a-d* of the radiation shielding rings 11*a-d* and the outer surface 40 of the inner shell 1 when under a heat load from radioactive materials stored within the cavity 42, it is preferred that the inner shell 1 be constructed of the same material as the radiation shielding rings 11*a-d* or of a material having a coefficient of thermal expansion that is greater than or substantially equal to the coefficient of thermal expansion of the material of which the radiation shielding rings 11*a-d* are constructed.

The collar 80*d* of the radiation shielding ring 11*d* is oriented facing downward for slidable mating/insertion into the channel 79*c* of what will be the adjacent radiation shielding ring 11*c* in the stacked assembly. The channel 79*d* of radiation shielding ring 80*d* is facing upward for receipt of the collar of the next radiation shielding ring to be added to the stack. If desired, the bottom surface of the collar 80*d* can be chamfered along its edge to facilitate the slidable mating of the collar 80*d* into the channel 79*c*.

The radiation shielding ring 11*d* is lowered until its collar 80*d* slides into the channel 79*c* of the adjacent radiation shielding ring 11. When fully lowered, the bottom surface 73*d* of the radiation shielding ring 11*d* will contact and rest atop the top surface 74*c* of the radiation shielding ring 11*c*, thereby forming a ring-to-ring interface. Such a ring-to-ring interface would normally be a concern for radiation escape (i.e., shining). However, because the collar 80*d* (which is constructed of a gamma radiation absorbing material) will extend both above and below the ring-to-ring interface, the danger of radiation shine is eliminated. As can be seen, a collar 80*b-c* is preferably located at each of the ring-ring-interfaces 83*b-c* formed between the adjacent radiation shielding rings 11*a-c* in the stacked assembly.

In the illustrated example, the channels 79*a-d* of the radiation shielding rings 11*a-d* are formed between the outer surface 40 of the inner shell and the second riser surfaces 78*a-d* of the radiation shielding rings 11*a-d*. However, in other embodiments the channels can be located in another radial position along either the top surface or the bottom surface of the radiation shielding rings 11*a-d*. For example, the channels can be centrally located at or near the middle wall of the ring body or at or near the outer surface of the ring body. When the location of the channel is changed, the location of the collar also should be changed in a corresponding manner on the other one of the top or bottom surfaces to facilitate the aforementioned sliding engagement/mating. In some embodiments, the existence of a channel to receive the collar may not even be necessary. In such embodiments, the collars can be located on the outer surfaces of the radiation shielding rings and extend over the ring-to-ring interface so as to surround the perimeter of the outer surface of the adjacent radiation shielding ring in the stack. Thus, as with the exemplified design, ring-to-ring interfaces are formed that are free of cracks through which radiation can shine.

The addition of the radiation shielding rings 11 to the stack continues as outlined above until the entire height of the inner shell 1 is surrounded in a sleeve-like manner. When constructed as shown in FIG. 7, the last radiation shielding ring put in place is the bottom-most radiation shielding ring 11A (FIG. 1).

As can be seen from FIG. 8, when the radiation shielding rings 11, 11A are in the stack, all of the voids 65*a-d* of each radiation shielding ring 11*a-d* are in spatial communication with all of the voids 65*a-d* of the adjacent radiation shielding rings 11*a-d*.

As a result, once the installation of the stack of the radiation shielding rings 11, 11A is complete, a solidifying neutron radiation absorbing liquid is poured into the voids 65 of the bottom-most radiation shielding ring 11A. Because the container 100 is upside down at this point, the solidifying neutron radiation absorbing liquid flows into and fills the voids 65 of all of the radiation shielding rings 11 in the stack. As discussed above, the geometric layout of the voids 65 ensures that all of the voids 65 of the radiation shielding rings 11, 11A are in spatial communication with all of the voids of the adjacent radiation shielding ring(s) 11, 11A, irrespective of the circumferential orientation (i.e., rotational position) of the radiation shielding rings 11, 11A.

By utilizing a plurality of radiation shielding rings 11, 11A that are considerably shorter in height than the inner shell 1, the danger of getting a radiation shielding ring 11, 11A stuck on the inner shell 1 before it is in position properly due to premature cooling is reduced. It is preferred that the height of the body 70 radiation shielding rings 11, 11A be less than or equal to one-third of the cavity 42. Moreover, by utilizing a plurality of radiation shielding rungs 11, 11A, the height of any HLW container 100 can be increased/decreased as desired with minor design and tooling modification.

Once the solidifying neutron radiation absorbing liquid properly fills all of the voids 65 of the radiation shielding rings 11, 11A, the second end plate 7 is secured to the bottom of the bottom-most ring 11A. via welding or another sealing technique This prevents the liquid from escaping. The bottom forging 4 is then secured to the second end plate 7 and the base plate 2 of the inner shell.

Figure 9:
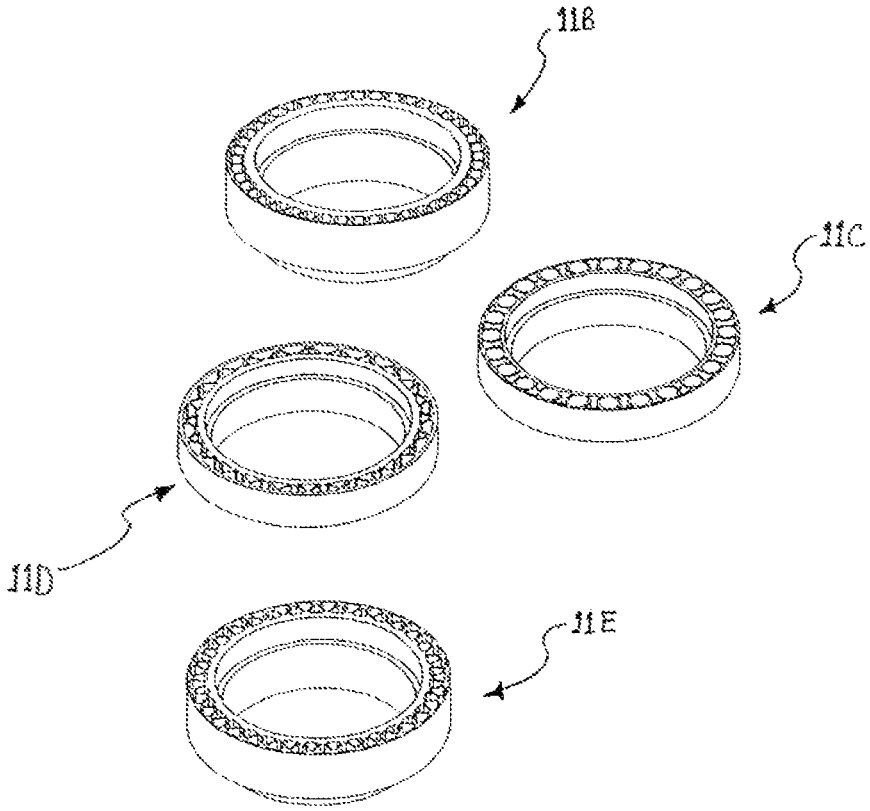
FIG. 9 is a perspective view of four radiation shielding rings according to alternative embodiments of the present invention.

Referring to FIG. 9, alternate embodiments 11B-11E of the radiation shielding rings 11, 11A are illustrated. Notably, the shape and geometric layout of the voids 65 are different. However, the principles outlines above are maintained despite the changes in shape and layout.

Figure 10:
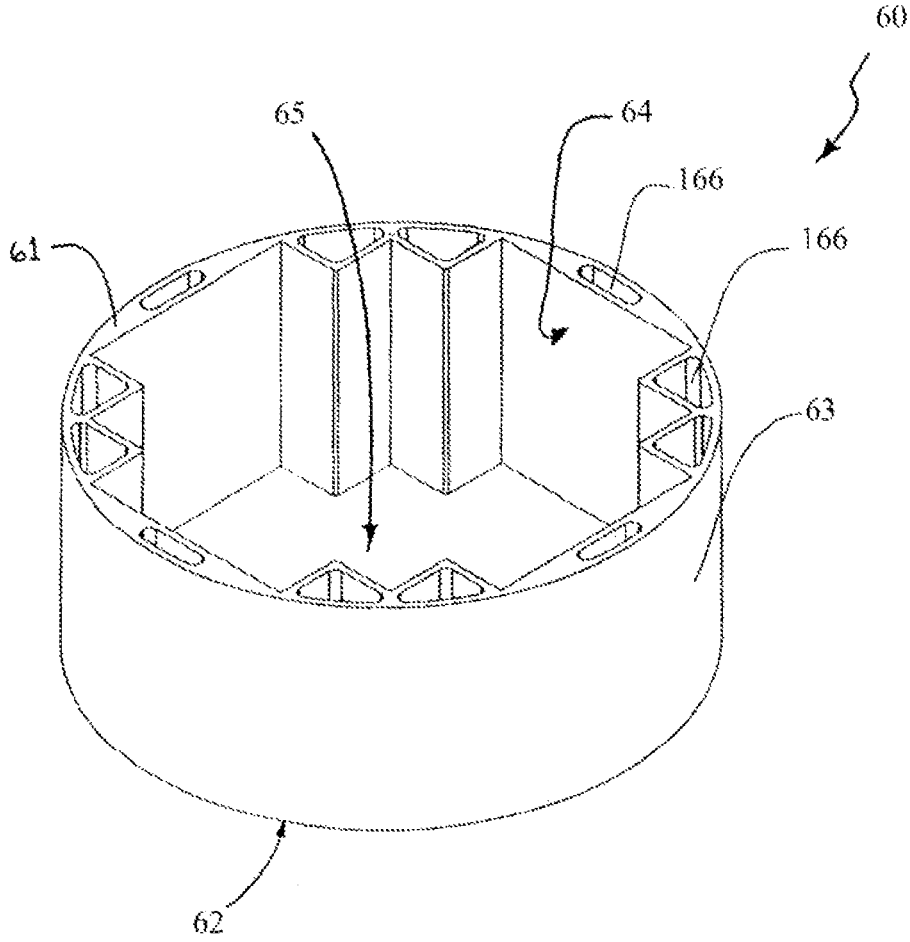
FIG. 10 is a perspective view of a spacer according to one embodiment of the present invention.

Referring now to FIG. 10, the structure of the spacers 60 will be described in greater detail. The spacers 60 are ring-like structures that serve a multitude of purposes for the container 100, including structural support for the basket 13, a heat transfer path from the basket 13 to the inner shell 1 and radiation shielding.

The spacer 60 has a top surface 61, a bottom surface 62, an outer surface 63 and an inner surface 64. The inner surface 64 forms a central passageway 165 through the spacer 60. The central passageway 165 is specially designed to accommodate the basket 13, which extends therethrough. The spacer 60 is preferably constructed of a material that has a coefficient of thermal expansion that is greater than the coefficient of thermal expansion of the material of which the inner shell 1 is constructed. The spacer 60 is to be constructed of a material that has a coefficient of thermal expansion that is preferably at least 20% greater than the coefficient of thermal expansion of the material of which the inner shell 1 is constructed. More preferably, the spacer 60 is constructed of a material having a higher thermal expansion coefficient than the rest of the components of the body portion 20 of the container 100, and most preferably at least 20% than the rest of the components of the body portion 20. In one embodiment, the spacer 60 is constructed of aluminum because of its excellent heat transfer properties, low weight and high thermal expansion coefficient.

Lightening holes/passageways 166 can be provided to lighten the weight and reduce the amount of material required to manufacture the spacer 60. The spacer 60 may be fabricated in stackable segments to achieve the desired height or in multiple radial segments. The spacer 60 can also be keyed to help maintain alignment through the stack. The spacer 60 can be fabricated by machining, lathing, forging, molten metal welding or any combination thereof.

The spacer 60 is fabricated slightly undersized with respect to the cavity 42 of the inner shell 1 so that it can fit easily therein during construction. When radioactive materials having a heat load are placed in the cask 100, the basket 13 and the spacer 60 can be heated. In turn, the spacer 60 swells so that is outer surface 64 makes intimate contact with the inner surface 41 of the inner shell 1 while its inner surface 64 makes intimate contact with the outer surface of the basket 13. This will be described in greater detail below with respect to FIGS. 13-14.

Figure 11:
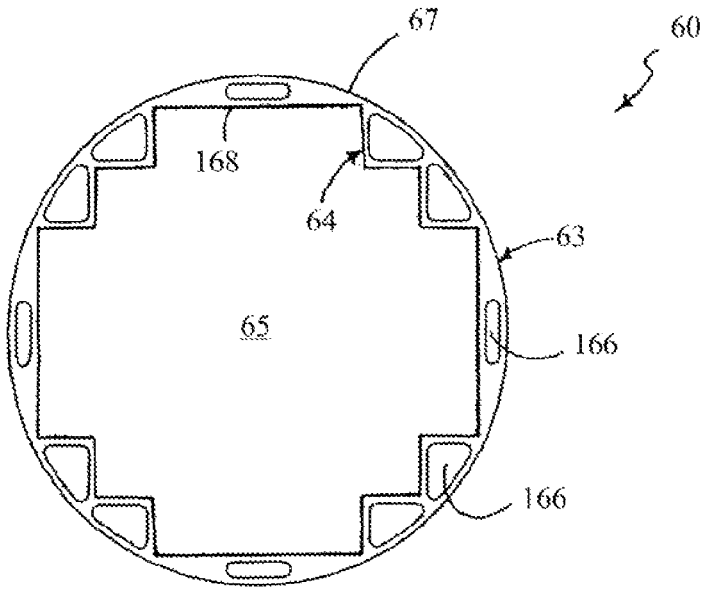
FIG. 11 is a top view of the spacer of FIG. 10.

Referring now to FIG. 11, a top view of the spacer 60 is shown. This top view of the spacer 60 is identical to a view of its horizontal cross-sectional profile. The horizontal cross-sectional profile of the spacer comprises an external perimeter 67 and an internal perimeter 68. The external perimeter 67 is formed by the outer surface 63 while the internal perimeter 68 is formed by the inner surface 64.

Referring now to FIG. 11, a top view of the spacer 60 is shown. This top view of the spacer 60 is identical to a view of its horizontal cross-sectional profile. The horizontal cross-sectional profile of the spacer comprises an external perimeter 67 and an internal perimeter 168. The external perimeter 67 is formed by the outer surface 63 while the internal perimeter 168 is formed by the inner surface 64.

The internal perimeter 168 of the spacer 60 is rectilinear in shape. However, the invention is not so limited and the internal perimeter 168 of the spacer 60 can take on any shape. It is preferred, however, that the shape of the internal perimeter 168 of the spacer 60 correspond to the shape of the external perimeter 54 of the basket 13 that is formed by its outer surface 52. The internal perimeter 168 is sized so that a small space 269 (FIG. 13B) exists between the inner surface 64 of the spacer 60 and the outer surface 52 of the basket 13 when the spacer 60 is positioned within the cavity 42 and the assembly is at ambient temperature. The spacer 60 of FIGS. 10 and 11 is specifically designed for use in conjunction with the basket 13 of FIG. 12, which has a rectilinear cross-sectional profile.

Figure 12:
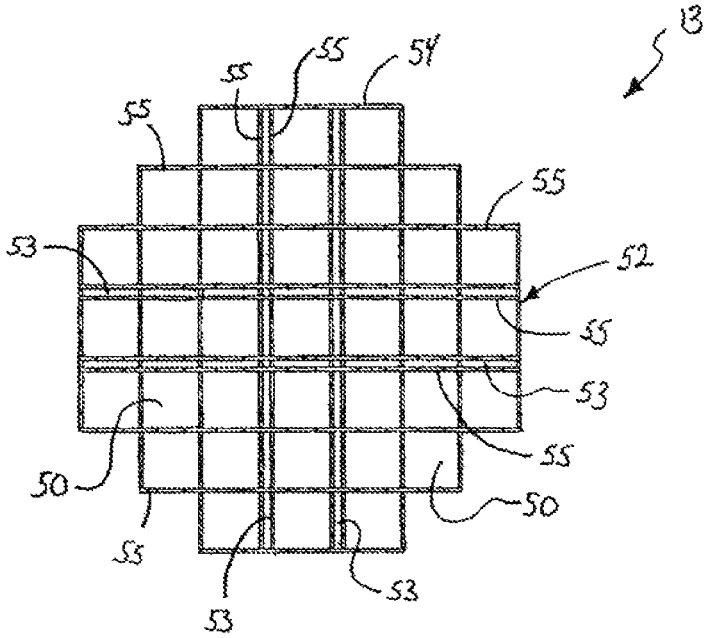
FIG. 12 is a top view of a basket designed to be used in conjunction with the spacer of FIG. 10 according to one embodiment of the present invention.

Referring to FIG. 12, the basket 13 has a horizontal cross-sectional profile having an external perimeter 54 formed by its outer surface 52. The basket 13 is designed so that when it is positioned in the cavity 42 of the inner shell, it will extend through the central passageways 165 of the stack of spacers 60. As can be seen by comparing FIGS. 11 and 12, the internal perimeter 68 of the spacers 60 correspond to the external perimeter 54 of the basket 13 in size and shape. This will be discussed in greater detail below with respect to FIGS. 13-4.

Referring to FIG. 12, the basket 13 has a horizontal cross-sectional profile having an external perimeter 54 formed by its outer surface 52. The basket 13 is designed so that when it is positioned in the cavity 42 of the inner shell, it will extend through the central passageways 165 of the stack of spacers 60. As can be seen by comparing FIGS. 11 and 12, the internal perimeter 168 of the spacers 60 correspond to the external perimeter 54 of the basket 13 in size and shape. This will be discussed in greater detail below with respect to FIGS. 13-4.

Figure 13A:
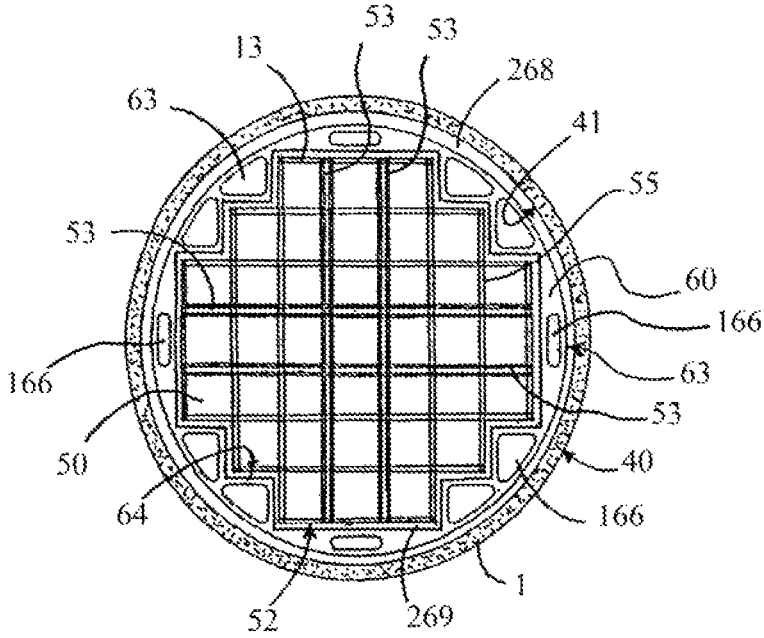
FIG. 13A is a top view of an assembly of the spacer of FIG. 10 and the basket of FIG. 12 positioned within the cavity of the inner shell of the container of FIG. 1 at ambient temperature.
Figure 13B:
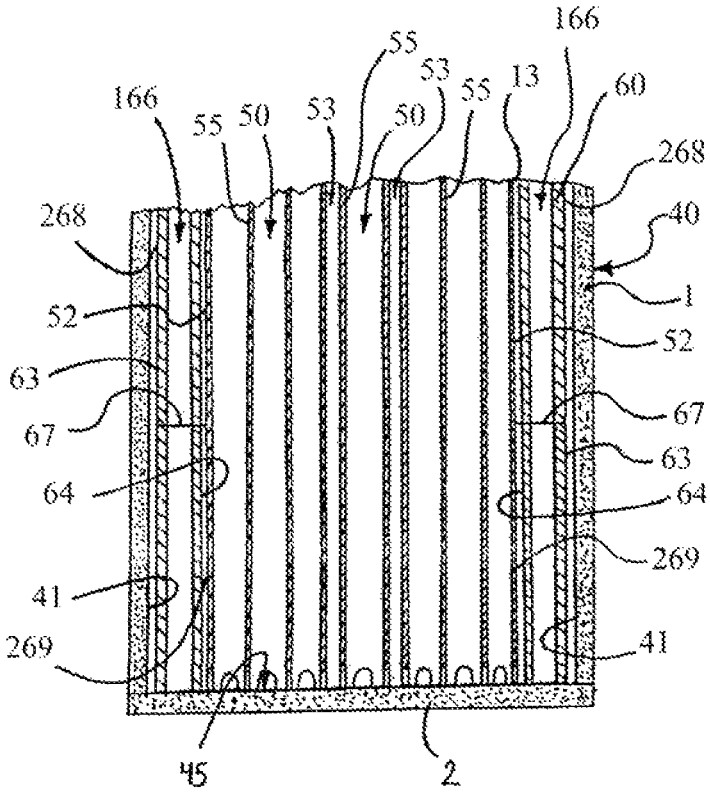
FIG. 13B is vertical cross-sectional view of a portion of the assembly of FIG. 13A along line XIII-XIII.

Referring first to FIGS. 13A and 13B simultaneously, the inner shell 1 having an empty cavity 42 is first provided. A plurality of spacers 60 are then positioned in the cavity 42 in a stacked assembly so that their central passageway 165 are substantially aligned. The top and bottom surfaces 61, 62 of adjacent spacers 60 form spacer-to-spacer interfaces 67. A sufficient number of spacers 60 are provided so that the entire height of the cavity 42 is filled. The spacers 60 may be keyed to ensure proper alignment in some embodiments.

Once the spacers 60 are in place, the empty basket 13 is positioned within the cavity 42 by slidably inserting the basket 13 through the central passageways 165 of the spacers 60 until the basket 13 rests on the floor 45 of the cavity 42. The basket 13 is in a substantially vertical orientation at this time. The elongated cells 50 of the basket are similarly in a vertical orientation so that radioactive waste, such as SNF rods, can be inserted into the cells from the open top end of the cavity 42.

In FIGS. 13A and 13B, the assembly of the inner shell 1, the spacers 60 and the basket 13 is shown at ambient temperature, such as when the container 100 is empty and no heat load is experienced. Under such a condition, a small annular gap/space 268 exists between the outer surface 63 of the spacers 60 and inner surface 41 of the inner shell 1. It is preferred that the size of this space/gap 268 be sufficiently small so that when the basket 13 is loaded with radioactive waste having a residual heat load, such as SNF rods, the spacers 60 expand so that the outer surface 63 of the spacers 60 come into substantially continuous surface contact with and press against the inner surface 41 of the inner shell 1, thereby eliminating the space/gap 268 (illustrated in FIGS. 14A and 14B). Substantially continuous surface contact opens the door wide open for heat to be conducted away from the radioactive waste.

Figure 14A:
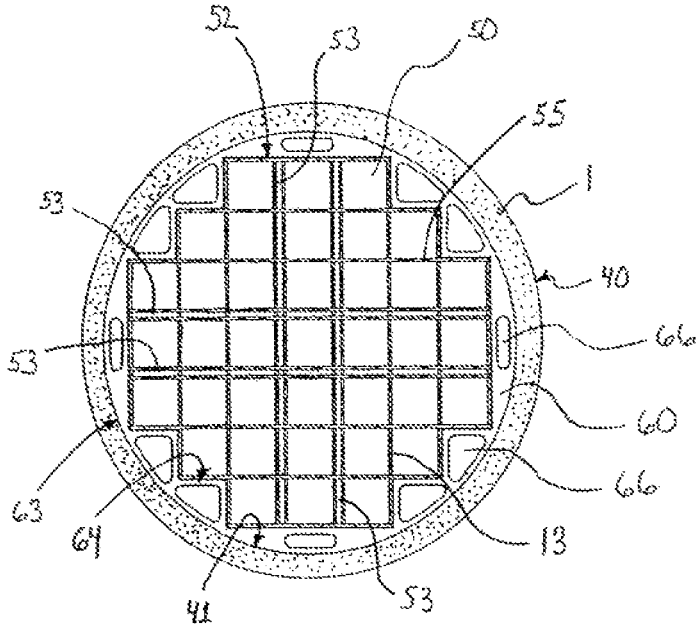
FIG. 14A is a top view of the assembly of FIG. 13A when under a heat load from HLW positioned in the cavity.
Figure 14B:
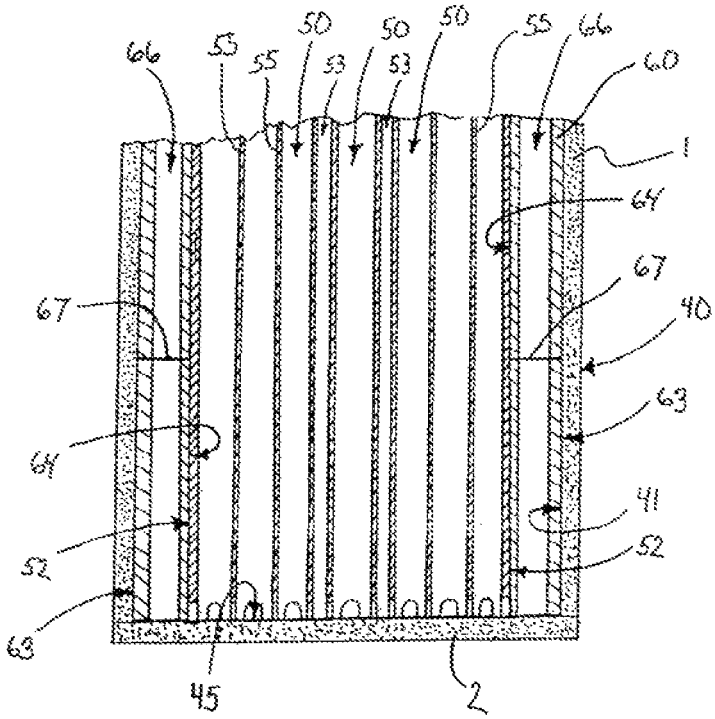
FIG. 14B is vertical cross-sectional view of a portion of the assembly of FIG. 14A along line XIV-XIV.

Similarly, at ambient temperature, a small gap 269 exists between the outer surface 52. of the basket 13 and the inner surface 64 of the spacers 60. it is preferred that this space/gap 269 be sized so that when the basket 13 is loaded with radioactive waste having a residual heat load, such as SNF rods, the spacers 60 (and/or the basket 13) expand so that the inner surfaces 64 of the spacers 60 come into substantially continuous surface contact with and press against the outer surface 52 of the basket 13, thereby eliminating the space/gap 269 (illustrated in FIGS. 14A and 14B). Substantially continuous surface contact opens the door wide open for heat to be conducted away from the radioactive waste.

Referring now to FIGS. 14A and 14B, the assembly of the inner shell 1, the spacers 60 and the basket 13 is shown at an elevated temperature (i.e., above ambient temperature), such as when the basket 13 is loaded with radioactive materials having a residual heat load. When the container 100 is loaded with radioactive materials having a residual heat load, such as SNF rods, heat is transferred to the basket 13, the spacers 60 and the inner shell 1. As a result of this heat load, the basket 13, the spacers 60 and the inner shell 1 expand due to the phenomena of thermal expansion.

Because the spacers 60 are constructed of a material having a greater coefficient of thermal expansion than that of the inner shell 1, the spacer 60 expands at a greater rate and a larger amount than the inner shell 1. As a result, the outside surfaces 63 of the spacers 60 becomes pressed against the inner surface 41 of the inner shell 1, thereby eliminating the space/gap 268 (present in FIGS. 13A and 13B). Similarly, the space/gap 269 between the inner surface 64 of the spacers and the outer surface 52 of the basket 13 to come into substantially continuous surface contact with the inner surfaces 64 of the spacers 60 and to be under compression. The thermal expansion also preferably causes the outer surface 63 of the spacers 60 to come into substantially continuous surface contact with the inner surface 41 of the inner shell 1 and to be under compression. It is preferred that size of the gaps 268, 269 and/or the materials of which the shell 1, the spacers 60 and/or the basket 13 are to be constructed so that the compression and continuous surface contact are achieved at a temperature range for which the system is designed.

The thermal expansion causes the outer surface 52 of the basket 13 to come into substantially continuous surface contact with the inner surfaces 64 of the spacers 60 and to be under compression. The thermal expansion also preferably causes the outer surface 63 of the spacers 60 to come into substantially continuous surface contact with the inner surface 41 of the inner shell 1 and to be under compression. It is preferred that size of the gaps 68, 69 and/or the materials of which the shell 1, the spacers 60 and/or the basket 13 are to be constructed so that the compression and continuous surface contact are achieved at a temperature range for which the system is designed.

Figure 15:
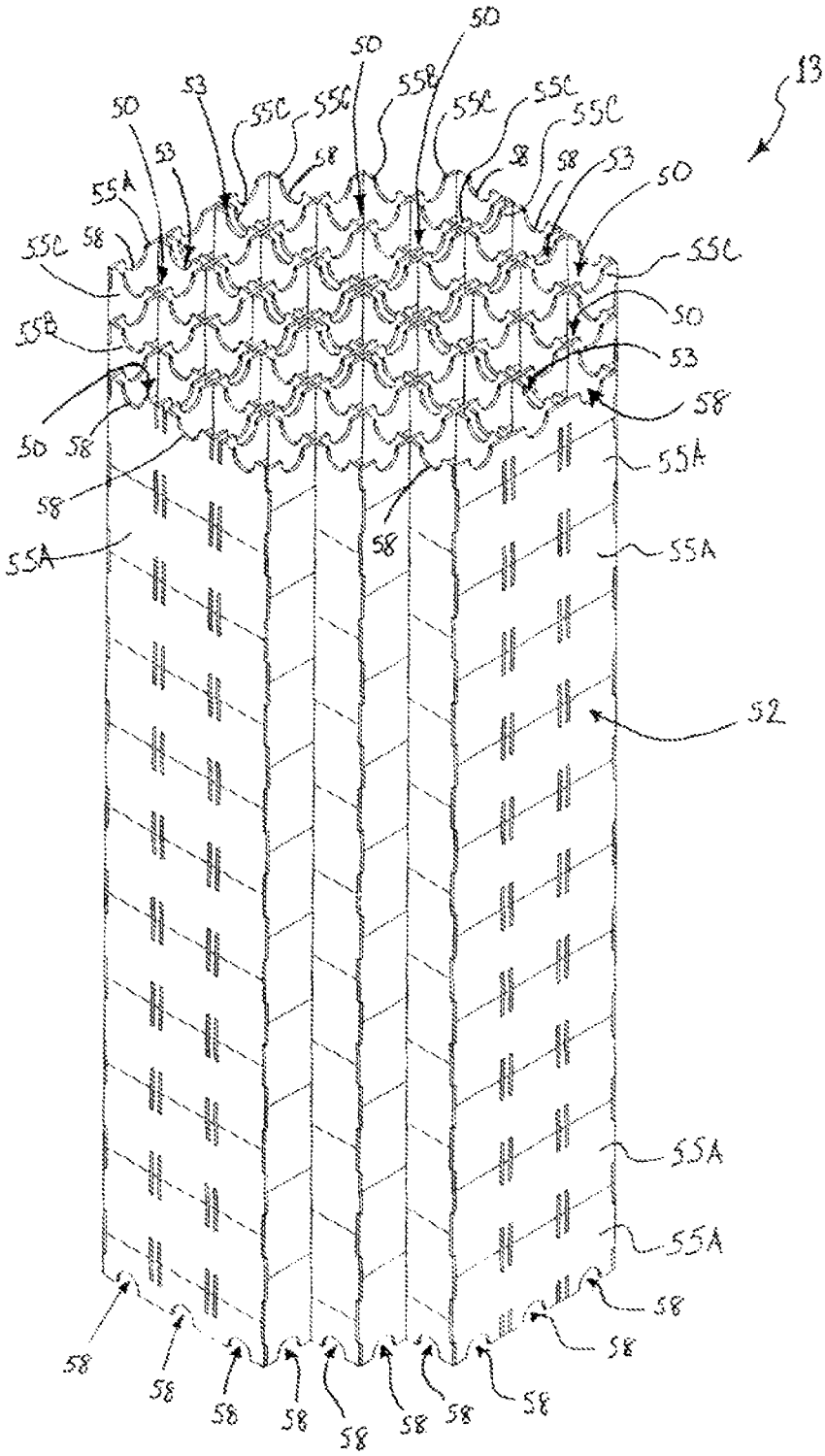
FIG. 15 is a perspective view of a basket for receiving HLW according to an embodiment of the present invention.
Figure 16:
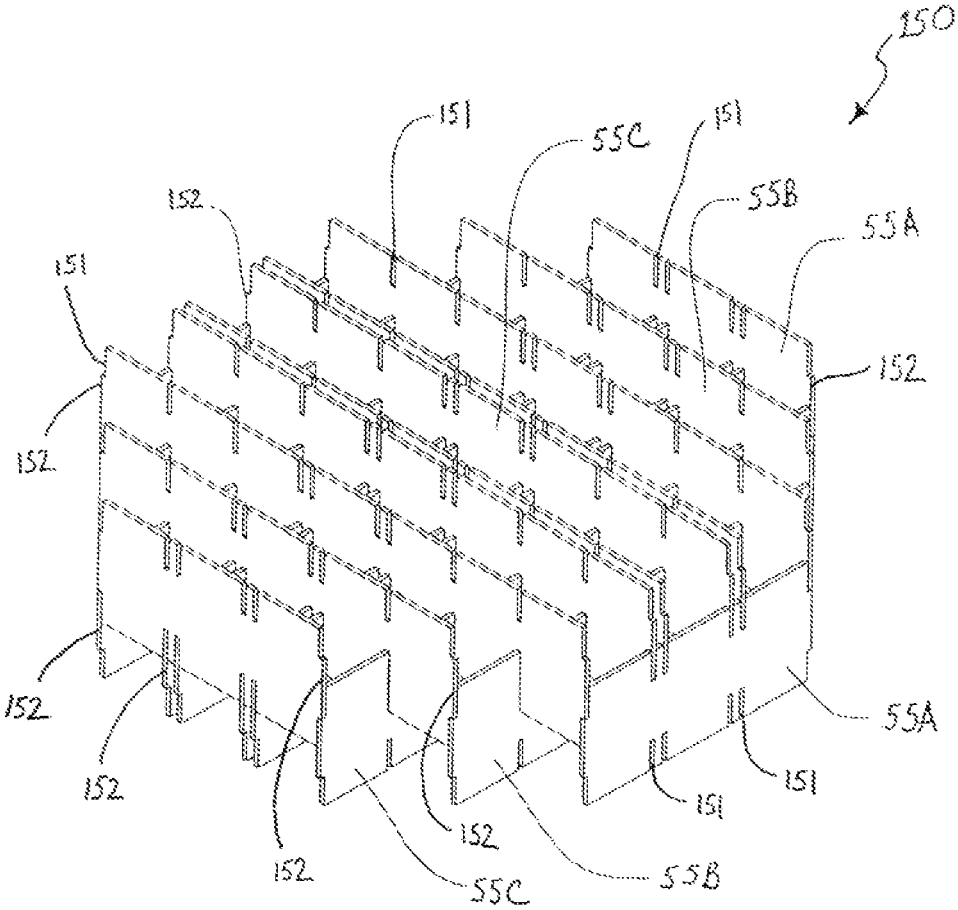
FIG. 16 is a perspective view of a middle segment of the basket of FIG. 15.
Figure 17:
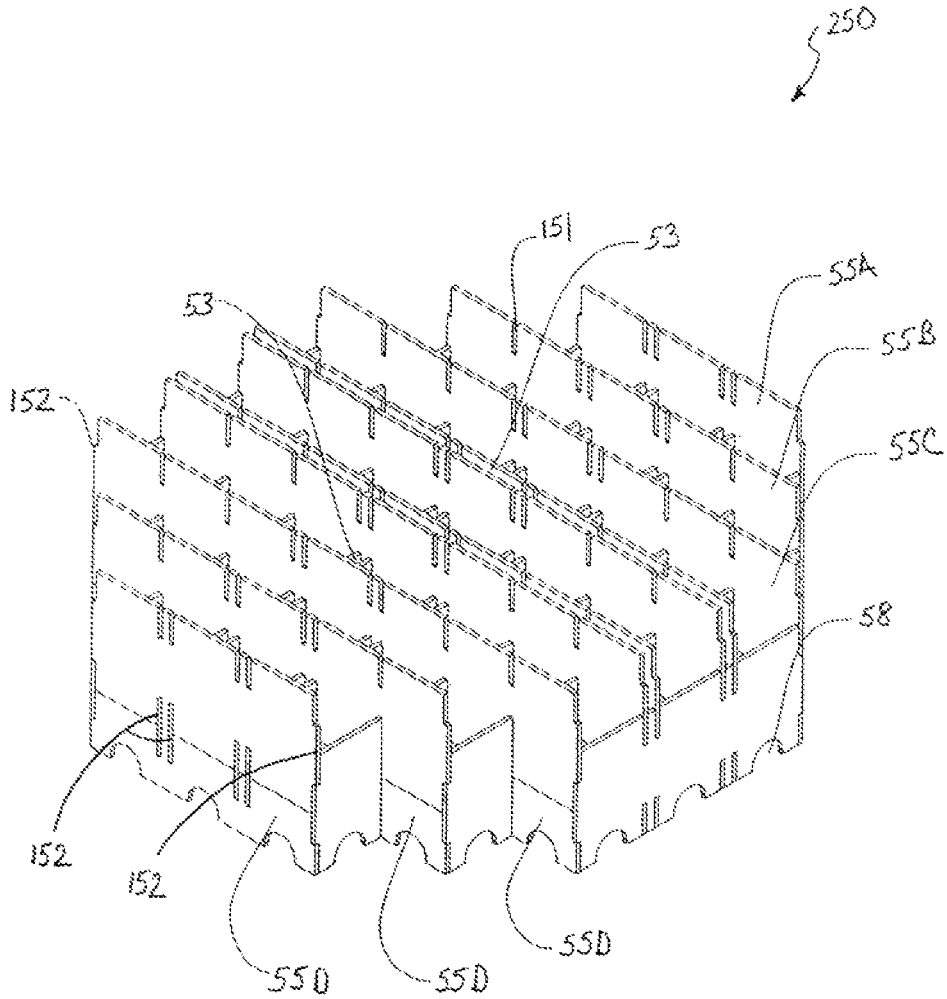
FIG. 17 is a perspective view of a bottom segment of the basket of FIG. 15.

Referring now to FIGS. 15-17, the basket 13 and its construction will be described. Starting with FIG. 15, the basket 13 is an assembly of slotted plates 55A-C. The plates 55A-C form a honeycomb-like gridwork arranged in a rectilinear configuration. The plates 55A-C are arranged at an approximately 90 degree angle to each other. The gridwork of plates 55A-C form a plurality of elongate cells 50 therebetween. For ease of representation (and in order to void clutter), only a few of the plates 55A-C and the cells 50 are numerically identified in FIG. 15.

The cells 50 are substantially vertically oriented spaces having a generally rectangular horizontal cross-sectional configuration. Each cell 50 is designed to accommodate a single SNF rod. The basket 13 (and thus the cells 50) has a height that is greater than or equal to the height of the SNF rods for which the basket 13 is designed to accommodate. The basket 13 preferably comprises between 12 to 120 storage cells 50.

The basket 13 also comprises a plurality of flux traps 53 that regulate the production of neutron radiation and prevent criticality in a flooded condition. The flux traps 53 are small spaces that extend the height of the basket 13. The flux traps 53 are formed between two of the plates 55C that are close to one another and substantially parallel. The flux traps 53 are designed so as to be too narrow to accommodate an SNF rod. In one embodiment, the flux traps 53 are approximately nine (9) centimeters wide. Of course, other dimensions are acceptable.

A total of four flux traps 53 are provided in the basket 13. A first pair of parallel flux traps 53 extend from opposing lateral sides of the basket 13. A second pair of parallel flux traps 53 extends substantially perpendicular to the first pair of parallel flux traps 53 and from the remaining opposing lateral sides of the basket 13.

The plates 55A-C are preferably constructed of a metal matrix composite material. More preferably, the plates 55A-C are constructed of a metal ceramic that is high in Cr—$Al_2O_3$. Most preferably, the plates 55A-C are constructed of Metamic. In some embodiments, however, the basket can be constructed of alternate materials, such as steel or borated stainless steel.

A plurality of cutouts 58 are provided in the plates 55A-C at both the top and bottom of the basket 13. For ease of representation (and in order to void clutter), only a few of the cut-outs 58 are numerically identified in FIG. 15. The cutouts 58 form passageways through the plates 55A-C so that all of the cells 50 are in spatial communication. As a result, the cutouts 58 at or near the bottom of the basket 13 act as a bottom air plenum while the cutouts at or near the top of the basket act as a top air plenum. These plenums help circulate air within the basket 13 (and the cavity 42) to effectuate convective cooling of the stored SNF rods during storage and/or transportation. This natural circulation of air can be further facilitated by leaving one or more of the cells 50 along the periphery of the basket 13 empty so that they can act as downcomers. The downcomer passageways preferably extend from the top plenum create by the cutouts 58 at the top of the basket 13 to the bottom plenum created by the cutouts 58 at the top of the basket 13. The cutouts 58 are semi-circular in shape in the illustrated embodiment but can take on a wide variety of shapes.

Alternatively, the passageways 166 of the spacers 60 can be used as downcomers by providing cutouts/holes that lead from the passageways 166 to the cells 50 at or near the plenums. These cutouts/holes put the cells 50 and the passageways 166 in spatial communication with one another. The cutouts/holes in the spacers 60 should be provided both at or near the top of the cavity 42 and at or near the bottom of the cavity 42. Most preferably, the cutouts/holes are located near the cutouts 58 in the top and bottom of the basket 13 so that the downcomer passageways 166 extend from the top plenum created by the cutouts 58 at the top of the basket 13 to the bottom plenum created by the cutouts 58 at the bottom of the basket 13.

Referring still to FIG. 15, the basket 13 is formed by a plurality of segments of the plates 55 that are arranged in a stacked assembly. A single middle segment 150 of the basket 13 is illustrated in FIG. 16. The segments 150 and the plates 55A-C slidably intersect and interlock with one another to form the stacked assembly that is the basket 13.

Referring now to FIG. 16, a single middle segment 150 of the basket is illustrated. Each segment 150 of the basket 13 comprises the honeycomb-like gridwork of plates 55A-C arranged in the rectilinear configuration. The plates 55A-C of the basket 13 comprise a plurality of slots 151 and end tabs 152 to facilitate sliding assembly.

A plurality of slots 151 are provided in both the top and bottom edges of the plates 55A-55C. The slots 151 on the top edge of each plate 55A-C are aligned with the slots 151 on the bottom edge of that plate 55A-C. The slots 151 extend through the plates 55A-C for one-fourth of the height of the plates 55A-C. The end tabs 152 extend from lateral edges of the plates 55A-C and are preferably about one-half of the height of the plates 55A-C. The end tabs 152 slidably mate with slots 151 cut into the plates 55A-C at the lateral edges. The plates 55A-C are slotted prior to being assembled.

The plates 55A-C slidably engage one another to form the basket 13 when the segments 150 are arranged in a stacked assembly. More specifically, the slots of each segment 150 intersect with the slots 151 of the adjacent segment 150. The plates 55A-C intersect and interlock when one plate 55A-C is arranged at a 90 degree angle to a second plate 55A-C so that the aligned slots 151 of the two plates intersect. The slots 151 and end tabs 152 of the segments 150 interlock the adjacent segments 150 together so as to prohibit relative horizontal and rotational movement between the segments 150. The basket 13 preferably comprises at least four of the segments 150, and more preferably at least ten segments 150. All of the segments 150 have substantially the same height and configuration.

The entire segment 150 is formed of plates 55A-C having no more that three different configurations. In fact, the entire basket 13 is formed of plates 55A-C having no more than three different configurations, with the exception that the cutouts 158 have to be added to the plates 55A-C of the top and bottom segments 150 and a few plates 55A-C have to be cut down to form end plates 55D (FIG. 17)

Referring now to FIG. 17, the bottom-most segment 250 in the stacked assembly that forms the basket 13 is illustrated. The bottom-most segment 250 is identical to the middle segment of 150 of FIG. 16 with the exception that the cutouts 58 are provided and end plates 55D are used. The end plates 55D are identical to the plates 55A-C except that they have been cut down as necessary. The upper-most segment in the stacked assembly that forms the basket is identical to segment 250 except that it is upside down.

While the basket 13 has been described in conjunction with its incorporation into thermally conductive casks, such as container 100, the basket 13 of the present invention is not so limited. For example, the basket 13 can be incorporated into a hermetically sealable multi-purpose canister for use in conjunction with VVO style containment systems. In such an embodiment, the basket 13 will be provided in a cavity formed by a cylindrical metal shell. The metal shell will encircle the basket 13 and a metal base plate may be welded to the bottom of the metal shell. A metal closure plate can be fitted on top of the cylinder formed by the metal shell, thereby forming a canister.

While the invention has been described and illustrated in sufficient detail that those skilled in this art can readily make and use it, various alternatives, modifications, and improvements should become readily apparent without departing from the spirit and scope of the invention.

What is claimed is:

1. An apparatus for containing radioactive materials having a residual heat load comprising:

a body having an inner surface that forms a cavity for receiving radioactive materials, the cavity having an open top end and a dosed bottom end, the cavity having a horizontal cross-sectional profile having a perimeter formed by the inner surface of the body;

a basket formed of a plurality of intersecting plates positioned in the cavity, the basket comprising a plurality of cells, the basket having an outer surface;

a plurality of spacers having a top surface, a bottom surface, an outer surface, and an inner surface forming a central passageway, the spacers arranged in a stacked assembly within the cavity the basket extending through the central passageways of the spacers of the stacked assembly; and wherein an entirety of the outer surface of the basket is in conformal surface contact with the inner surfaces of the spacers.

2. The apparatus of claim 1 further comprising:

the plurality of spacers having a substantially constant horizontal cross-section from the top surface to the bottom surface, the spacers arranged in the stacked assembly within the cavity so that the top and bottom surfaces of adjacent spacers are in surface contact with one another so as to form a spacer-to-spacer interface; and means for maintaining the spacers of the stacked assembly in alignment.

3. The apparatus of claim 1 wherein one or more of the spacers are keyed to maintain alignment of the stacked assembly.

4. The apparatus of claim 1 wherein an entirety of the outer surfaces of the spacers is in conformal surface contact with the inner surface of the body.

5. The apparatus of claim 1 further comprising:

a lid enclosing the open top end of the cavity, each of the spacers comprising a passageway extending from the top surface to the bottom surface;

wherein when arranged in the stacked assembly, the passageways of the spacers form a downcomer extending from a top plenum of the cavity to a bottom plenum of the cavity; and wherein the downcomer has a substantially constant horizontal cross-sectional area from the top plenum to the bottom plenum.

6. The apparatus of claim 1 wherein the stacked assembly comprises a top end and a bottom end, the stacked assembly having a substantially constant horizontal cross-section from the top end to the bottom end.

7. An apparatus for containing radioactive materials having a residual heat load comprising:

a body comprising an inner surface that forms a cavity for receiving radioactive materials, the cavity having an open top end and a closed bottom end;

a basket positioned in the cavity and comprising a plurality of cells, the basket having a horizontal cross-sectional profile having an external perimeter formed by an outer surface of the basket;

a plurality of ring structures having a top surface, a bottom surface, an outer surface, and an inner surface forming a central passageway, the ring structures arranged in a stacked assembly within the cavity so that the top and bottom surfaces of adjacent ring structures in the stacked assembly are in direct surface contact with one another, each of the ring structures having a horizontal cross-sectional profile having an internal perimeter formed by the inner surface of the ring structure and an external perimeter formed by the outer surface of the ring structure; and wherein the basket extends through the central passageways of the ring structures so that an entirety of the external perimeter of the basket is in conformal surface contact with the internal perimeters of the ring structures.

8. The apparatus of claim 7 wherein each of the ring structures is constructed of a material having a first coefficient of thermal expansion and the body is constructed of a material having a second coefficient of thermal expansion, the first coefficient of thermal expansion being greater that the second coefficient of thermal expansion.

9. The apparatus of claim 8 wherein each of the ring structures comprise a plurality of passageways extending from the top surface to the bottom surface, and the passageways of the ring structures form a plurality of downcomers extending from a top plenum of the cavity to a bottom plenum of the cavity when arranged in the stacked assembly, each of the plurality of downcomers having a substantially constant horizontal cross-section from the top plenum to the bottom plenum.

10. The apparatus of claim 8 further comprising:

a first plurality of cutouts provided at a top of the basket so that the cells are in spatial communication with each other, thereby forming a top plenum;

a second plurality of cutouts provided at a bottom of the basket so that the cells are in spatial communication with each other, thereby forming a bottom plenum; and each of the ring structures comprising a plurality of passageways extending from the top surface to the bottom surface, the passageways of the ring structures forming a plurality of downcomers extending from the top plenum to the bottom plenum when arranged in the stacked assembly; and wherein each of the plurality of downcomers has a substantially constant horizontal cross-section from the top plenum to the bottom plenum.

11. The apparatus of claim 8 wherein the first coefficient of thermal expansion is at least 20 percent times greater than the second coefficient of thermal expansion.

12. The apparatus of claim 7 further comprising:

the cavity having a horizontal cross-sectional profile having a perimeter formed by the inner surface of the body; and an entirety of the external perimeters of the ring structures is in conformal surface contact with the perimeter of the body.

13. The apparatus of claim 7 wherein each of the ring structures is a unitary structure.

14. An apparatus for containing radioactive materials having a residual heat load comprising:

a body comprising an inner surface that forms a cavity for receiving radioactive materials, the cavity having an open top end and a closed bottom end;

a basket comprising a plurality of cells positioned in the cavity, the basket having an outer surface;

a plurality of ring structures having a top surface, a bottom surface, an outer surface, and an inner surface forming a central passageway, the ring structures arranged in a stacked assembly within the cavity; and the basket extending through the central passageways of the ring structures so that an entirety of the outer surface of the basket is in conformal surface contact with the inner surface of the ring structures.

15. The apparatus of claim 14 wherein each of the ring structures is a unitary structure.

16. The apparatus of claim 14 further comprising:

the ring structures having a substantially constant horizontal cross-section from the top surface to the bottom surface, the ring structures arranged in the stacked assembly within the cavity so that the top and bottom surfaces of adjacent ring structures in the stacked assembly are in direct surface contact with one another and the stacked assembly has a substantially constant horizontal cross-section along its entire height; and means for maintaining the ring structures of the stacked assembly in alignment.

17. The apparatus of claim 14 wherein an entirety of the outer surfaces of the ring structures is in conformal surface contact with the inner surface of the body.

18. The apparatus of claim 14 further comprising:

the cavity having, a horizontal cross-sectional profile having a perimeter formed by the inner surface of the body;

each of the ring structures having an external perimeter formed by the outer surface of the ring structure; and wherein the perimeter of the cavity is circular, and wherein the external perimeter of the basket is of a shape that is not circular.

19. An apparatus for containing radioactive materials having a residual heat load comprising:

a body comprising an inner surface that forms a cavity for receiving radioactive materials, the cavity having an open top end and a closed bottom end;

a basket comprising a plurality of cells positioned in the cavity, the basket having an outer surface;

a plurality of ring structures having a top surface, a bottom surface, an outer surface, and an inner surface forming a central passageway, the ring structures arranged in a stacked assembly within the cavity; and the basket extending, through the central passageways of the ring structures so that a first clearance exists between the inner surfaces of the ring structures in the stacked assembly and the outer surface of the basket at ambient temperature, the first clearance circumferentially surrounding the basket; and wherein upon radioactive materials having, a residual heat load being positioned in the basket, the residual heat load from the radioactive materials causes the basket to expand so that an entirety of the outer surface of the basket is in conformal surface contact with the inner surfaces of the ring structures and the first clearance is eliminated.

20. The apparatus of claim 19 further comprising:

a second clearance between the inner surface of the body and the outer surfaces of the ring structures in the stacked assembly at ambient temperature, the second clearance circumferentially surrounding the stacked assembly; and wherein upon positioning, the radioactive materials having a residual heat load in the basket, the residual heat load of the radioactive materials causes the ring structures to expand so that an entirety of the outer surfaces of the ring structures is in conformal surface contact with the inner surface of the body and the second clearance is eliminated.

21. The apparatus of claim 20 wherein the plurality of ring structures are constructed of a material having a first coefficient of thermal expansion and the inner surface of the body is constructed of a material having a second coefficient of thermal expansion, the first coefficient of thermal expansion being greater that the second coefficient of thermal expansion.

* * * * *